US008001899B2

(12) United States Patent
Breunig et al.

(10) Patent No.: US 8,001,899 B2
(45) Date of Patent: Aug. 23, 2011

(54) METHOD FOR SUPPLYING A WEB OF MATERIAL OF PREDETERMINED LENGTH TO A PRINTING PRESS FOR PRODUCING A PRINTED PRODUCT

(75) Inventors: Hartmut Breunig, Arnstein (DE); Josef Herbert Olbort, Mainbernheim (DE); Walter Ritter, Grünsfeld (DE)

(73) Assignee: Koenig & Bauer Aktiengellschaft, Wurzburg (DE)

( * ) Notice: Subject to any disclaimer, the term of this patent is extended or adjusted under 35 U.S.C. 154(b) by 437 days.

(21) Appl. No.: 12/309,553

(22) PCT Filed: Jul. 25, 2007

(86) PCT No.: PCT/EP2007/057654

§ 371 (c)(1),
(2), (4) Date: Jan. 22, 2009

(87) PCT Pub. No.: WO2008/012323

PCT Pub. Date: Jan. 31, 2008

(65) Prior Publication Data

US 2009/0243204 A1 Oct. 1, 2009

(30) Foreign Application Priority Data

Jul. 27, 2006 (DE) ..... 10 2006 035 537
Sep. 15, 2006 (DE) ..... 10 2006 043 422

(51) Int. Cl.
*B41F 33/00* (2006.01)

(52) U.S. Cl. ..... 101/484; 101/228

(58) Field of Classification Search ..... 101/228, 101/484, 485; 242/554, 555
See application file for complete search history.

(56) References Cited

U.S. PATENT DOCUMENTS 3,298,890 A * 1/1967 Hellemans ..... 156/504
4,346,446 A * 8/1982 Erbstein et al. ..... 702/182
5,076,751 A 12/1991 Kafka
5,417,642 A 5/1995 Boronka et al.
5,584,245 A * 12/1996 Schonberg ..... 101/484

(Continued)

FOREIGN PATENT DOCUMENTS

DE 44 16 213 A1 11/1995

(Continued)

*Primary Examiner* — Stefanos Karmis
*Assistant Examiner* — Ernesto Suarez
(74) *Attorney, Agent, or Firm* — Jones, Tullar & Cooper, P.C.

(57) ABSTRACT

A printing device, which is usable to produce printed products, is supplied with a material web of a predetermined length. The length of the required web is defined by the printed product to be produced. The material web is assembled from several partial webs, having defined lengths. The supply of these partial webs to the printing device is provided automatically with the use of a material management system. A control unit of this system determines the length for the partial webs that have been chosen for a certain production request. These partial webs are sent to the printing device in a certain sequence so that the last one of these partial webs to be used has the least web length of the several partial webs. The minimum length of the last partial web is determined by an end of the partial web finishing the production. This sequence is determined, at the earliest, after the cycle time has ended. The cycle time is a time frame in which a material web, or a partial material web is prepared for its respective use in the printing device.

18 Claims, 13 Drawing Sheets

U.S. PATENT DOCUMENTS

| | | | | |
|---|---|---|---|---|
| 5,625,758 | A | 4/1997 | Schneider et al. | |
| 5,699,735 | A * | 12/1997 | Stein et al. | 101/219 |
| 6,155,516 | A * | 12/2000 | Lehrieder et al. | 242/559.3 |
| 6,827,012 | B1 * | 12/2004 | Palmatier | 101/225 |
| 7,463,943 | B2 | 12/2008 | Gretsch | |
| 2002/0124756 | A1 * | 9/2002 | Rai et al. | 101/484 |
| 2007/0177965 | A1 | 8/2007 | Gretsch et al. | |
| 2009/0217835 | A1 * | 9/2009 | Rozenblum | 101/484 |

FOREIGN PATENT DOCUMENTS

| | | | |
|---|---|---|---|
| DE | 102 45 658 | A1 | 4/2004 |
| EP | 0 570 334 | A1 | 11/1993 |
| EP | 0 639 456 | A1 | 2/1995 |
| EP | 0 710 558 | A1 | 5/1996 |
| EP | 1 712 362 | A2 | 10/2006 |
| WO | WO 2005/077797 | A2 | 8/2005 |

* cited by examiner

METHOD FOR SUPPLYING A WEB OF MATERIAL OF PREDETERMINED LENGTH TO A PRINTING PRESS FOR PRODUCING A PRINTED PRODUCT

CROSS-REFERENCE TO RELATED APPLICATIONS

This patent application is the U.S. National Phase, under 35 USC 371, of PCT/EP/2007/057654, filed Jul. 25, 2007; published as WO 2008/012323 A1 on Jan. 31, 2008 and claiming priority to DE 10 2006 035 537.7, filed Jul. 27, 2006 and to DE 10 2006 043 422.6, filed Sep. 15, 2006, the disclosures of which are expressly incorporated herein by reference.

FIELD OF THE INVENTION

The present invention is directed to a method for supplying a web of material of predetermined length to a printing press for producing a printed product. The length of the web of material is determined based on a print run of the printed product to be printed continuously. The web of material is comprised of a plurality of partial webs which are joined together in succession. These partial webs often have different lengths. A material management system is used to control a storage facility where the plurality of partial length webs are stored.

BACKGROUND OF THE INVENTION

A, a method of shifting a web-fed printing press, from a current production of a first printed product to a subsequent production of a second printed product, is known from EP 1 712 362 A2. The first printed product is produced from a first web of material which is currently being fed to the web-fed printing press. The second printed product is produced from a second web of material which is to be subsequently fed to the web-fed printing press. These webs of material differ from one another in terms of their respective widths and/or in the grade and/or base weight of their material. A time, at which the second web of material is to be connected to the first web of material, is determined by a control unit which controls at least the current production of the first printed product. This determination is made based upon the production data relevant to the second printed product. This production data is made available to the control unit. Characteristic data, regarding the second web of material is acquired by a barcode reader, which barcode reader is connected to the control unit for the purpose of data transmission. The barcode reader scans and reads a barcode label attached to the web of material, and data is provided to the control unit.

EP 0 710 558 A1 describes a web-fed rotary printing press with an adjustable roll changer for use in accommodating webs of print substrate of different widths. Print [, with print] cylinders can be engaged against one another, in a printing couple, in order to create print positions. The printing press is provided with an adjustable folding unit. The width of the roll changer, the positioning of the printing cylinder, and the locations of components of the folding unit can be adjusted in relation to one another automatically while the press is running, in order to shift production from a first printed product to a second printed product. The components of a folding unit, and especially a folding jaw opening and an expansion of a collecting cylinder, can be adjusted based upon the changed number of pages in the printed product. The shift in production is implemented on the basis of calculations and control commands, which are performed and are issued, respectively, by the roll changer.

The use of a production planning system to automatically provide production data to a control unit is known form EP 0639 456 A1. That system controls the production of a printed product.

A folding jaw cylinder for a printing press is known from EP 0570334 A1. An adjustment of a working distance of the cylinder's folding jaws is performed via a servo motor control. This adjustment is based upon adjustable control parameters that determine the working distance to be set, especially the number of pages in the printed product and, if applicable, the surface-specific weight of the paper.

A method of storing unprepared and prepared rolls of material for a web processing machine in a warehouse is known from WO 2005/077797 A2. Information, which is used to project consumption data for an impending production period, or projected consumption data, is fed to a material flow system. In a sub-process, a storage strategy is established by using the projected consumption data and the current inventory status.

SUMMARY OF THE INVENTION

In the discussion which now follows, a print shop is assumed, which print shop comprises at least one printing press, such as, for example, a web-fed printing press, and a material supply system. The material supply system supplies the printing press with a plurality of webs of material, each of which webs is configured as a print substrate. These webs of material are to be imprinted, in succession, in the web-fed printing press. For efficient production, it is necessary for the processes running in the printing press and the material supply system that is used with the printing press to be coordinated effectively with one another.

Each of the webs of material, which is to be imprinted in the printing press, is preferably configured as a paper web. Each of the webs of material, which is allocated to a specific print product to be produced, or at least a part of these webs, is preferably wound onto a respective roll. If the print product to be produced from the respective web of material has a large print run, such as, for example, a large number of copies, as is the case, for example, with a newspaper having several thousand copies per issue, a plurality of rolls must typically be provided to the printing press and are then fed into the printing process in succession to execute such a print order. Each such roll forms a partial web of the overall web of material which is required to execute the respective print order. The individual partial webs are supplied to the printing press in succession, for example, for use in the continuous production of copies of the printed product which corresponds to the print order. In each case, preferably the trailing end of a first partial web, that has already been almost completely imprinted in the current production run, for example, and a leading end of a next partial web, which is to be subsequently introduced into the production process, are joined. Together, the partial webs, which are lined up for the same production process, form a continuous web of material, the length of which is determined substantially based upon the print run of the print product to be produced. A plurality of partial webs, all belonging to the same web of material, and which are supplied as different ribbons by different roll changers of the printing press, for example, are supplied to the same folding unit at the same time.

The printing press operates, for example, using an intaglio printing process or a planographic printing process, and especially operates using an offset printing process. The offset printing process can be a conventional, wet offset printing process, such as, for example, one that uses a dampening agent, or it can be a dry offset printing process that prints without the use of a dampening agent.

The printed product, which is to be produced by the printing press, is preferably produced in a multicolor printing process, and especially is produced in a four-color printing process. A web of material to be printed in the printing press can be up to 4,500 mm wide, particularly if the intaglio printing method is used. If an offset printing process is used, the width of the web of material normally ranges from 1,000 mm to 2,400 mm, and preferably ranges from 1,200 mm to 2,400 mm. Each of the partial webs, which is required to execute a print job, can have a length within the range of several thousand meters. For example, a new roll of newsprint paper, as delivered from the paper plant, can hold a partial web with a length ranging from 18,000 m to 25,000 m, depending upon the base weight and/or type of paper. Despite this considerable length of each partial web, several of these partial webs are often required to execute certain print orders. A print order can involve even several tens of thousands of copies, as in the production of a newspaper, for example. A high capacity printing press with cylinders, configured, for example, as double-circumference cylinders, any with cylinders having a circumference ranging from 900 mm to 1,400 mm, and wherein each circumference has two section lengths, for example, with each such section length corresponding, for example, to the height of one newspaper page, produces approximately 90,000 copies of the respective printed product in a single hour in non-collect production and approximately 45,000 copies in collect production, for example. This type of printing press imprints a roll of the above-mentioned type within 20 minutes, for example, so that another partial web must stand ready and must be fed into the printing press for the uninterrupted continuation of production.

To supply the printing press with the partial webs, which partial webs are each wound onto rolls, a roll changer may be used. Such a roll changer connects partial webs to one another automatically, for example via splicing, during a current production run on the printing press. A roll that has been prepared for production is placed on support arms of the roll changer and is accelerated, based upon the current production speed of the printing press. The roll that has been prepared for production can be a new roll which holds the entire length of a partial web, or instead can be a residual roll which has already been used in a previous production run and which holds a length of material that was left over from the original length. A residual roll is therefore a roll that has been partially consumed in a production run. A new roll is a roll that has not yet been used in production.

The material supply system belonging to the printing press controls a main storage facility and a daily storage facility, for example. The main storage facility is used to store a larger stock of rolls of different base weights and/or of paper grades and/or of roll widths, for example, which rolls are delivered to the print shop by a paper plant, for example. The daily storage facility is generally used to hold in reserve rolls which have been removed from the main storage facility for only a current production run, and is preferably located in the immediate vicinity of the relevant printing press. One or more new rolls, and also one or more residual rolls, may be stored in the daily storage facility. The rolls that are stored in the daily storage facility are preferably automatically supplied in succession to the roll changer which is allocated to the appropriate printing press. In the daily storage facility, and also in the roll changer, at least two partial webs of unequal length can be held in reserve for an impending production run. A suitable transport system, such as an aisle stacker (RBG), a driverless transport system (AGV) or a crane, is used to transport the individual rolls within the main storage facility and/or between the main storage facility and the daily storage facility and/or between the daily storage facility and the roll changer. The provision of rolls to the daily storage facility is preferably performed automatically via the material supply system, which is equipped with a control unit. The material supply system calculates the number of rolls which will be required, on the basis of a preferably EDP-supported production planning system, which is positioned upstream of the printing process, or on the basis of data that is input manually into the control unit of the material supply system. The material supply system also controls the provision of the rolls, which are required to execute a specific print job, to the proper printing press at the proper time.

Each of the rolls of material has a core, typically made of cardboard, steel or aluminum, for example, and around which roll the respective partial web is concentrically wound. The core is also used to hold the respective roll on the roll changer. Cones mounted on parallel support arms, and which are situated opposite one another, and which can be variably adjusted with respect to their distance from one another, engage in the core of the respective roll by a decrease in the distance between the support arms at both ends of the roll. Once the roll has been engaged, the respective roll is raised from its respective lower position by a pivoting of the support arms around a shared axis extending parallel to the core. The now raised roll is taken up such that the respective circumferential surface of the raised roll is free from any direct contact with any other surface. The core of a roll of material, which material has been consumed to the extent that it can no longer be used in the production run on the printing press, or at least its use no longer makes sense, is ejected from the roll changer by a preferably automatic release from the respective cones. This now depicted roll of material is ultimately removed from the vicinity of the roll changer. The cones which engage the opposite ends of a core are rotatable. At least one of the cones which engage a core can be rotatably driven and is actuated to supply the partial web wound around this core to the printing press. This is done by placing the roll, which has been received in its stationary condition, into rotation. A drive, which is in active connection with the at least one cone, accelerates the rotational motion of the received roll until the circumferential speed of this roll corresponds to the current transport speed of the web of material to be imprinted in the printing press. At this point, the leading end of the replacement partial web, which is wound onto this received roll, can be automatically joined to the depleting partial web, that is still running in the current production process, preferably via an adhesive connection. The web of material to be printed is transported through the printing press at a transport speed ranging from 10 m/s to 15 m/s, for example, and preferably is transported at approximately 12 m/s. The transport speed of the web of material to be imprinted in the printing press is dependent upon the production speed of the printing press. The production speed of the printing press is frequently indicated in revolutions of the printing cylinder per hour. In a continuous production run, the cylinders of the printing press which are performing the print job, such as, for example, at least the transfer cylinders in an offset printing process, rotate at 40,000 or even 45,000 revolutions per hour, for example.

The time that is required for accomplishing the ejection of a core of a roll that has been consumed by the unwinding of its partial web down to a minimum diameter, for example, for a fresh roll to be supplied from the daily storage facility to, for example, the roll changer, for this fresh roll to be loaded onto the axis of the roll changer and for the roll changer to accelerate the roll makes up one cycle period. This cycle period may also contain an added safety margin to make up for potential delays in the execution of the aforementioned processes, for example. It is assumed, by way of example, that the cycle period, including a safety margin of 30 seconds, for example, amounts to approximately 420 seconds. It is therefore proposed that the partial web of the last depleting roll which is used in the execution of a print run of a specific print product to be continuously printed, has a minimum length which, at a current transport speed of the web of material to be imprinted in the printing press, is sufficient for a production run which will continue for the entire cycle period. If preparations for a subsequent production run are to be made during a current production run, the minimum length of this last partial web is also determined based upon the cycle period for the preparation of at least one partial web of a web of material assigned to a print run other than the current run, namely to the subsequent print run.

In planning for the use of the last partial web which is required to execute a current production run, preferably only the maximum transport speed of the web of material to be imprinted in the printing press is taken into account. However, the fact that the transport speed of the web of material to be imprinted in the printing press may be changed, during the use of this last partial web, and especially the possibility that this transport speed will be reduced from a higher level to a lower level or will even be decreased to zero, may also be taken into account. Determining the minimum required length of this last web section can therefore also be dependent upon a profile of this transport speed. This transport speed profile may have a course that is similar to the transport speed of at least one previously printed partial web, or one that changes, and especially one that is decreasing. The planned profile of the transport speed of the last partial web to be used in a current-production run is preferably stored in a memory device in the material supply system. Also stored in the memory of the material supply system is the length of the partial web of the new roll which is supplied to the roll changer. This indication of length can be input manually into the control unit of the material supply system, for example. Alternatively, a database may be stored in the memory of the material supply system, which database contains data from previous production runs to which the control unit of the material supply system can refer for its calculations. The data which may be stored in the database can be sorted based upon the base weight and/or the grade of the print substrate, for example. The residual length of a roll that has been partially used is calculated, at least approximately, for example, by the roll changer, preferably using the change in the diameter of that roll over a specific period of time. This residual length is reported to the control unit of the material supply system for storage there and/or for use by the material supply system.

Thus, the material supply system first determines the total length of the web of material required for the continuous production of a specific print run or even for a plurality of print runs of a specific type of print product to be printed successively. In the case of a plurality of print runs, which are to be printed successively, the individual partial runs must conform with one another in terms of their respective number of pages and in terms of the base weight and grade of the print substrate to be used. If the individual partial runs do not conform, in terms of their respective number of pages and/or in their respective base weight and/or grade of print substrate to be used, copies of the respective print product which would differ in terms of their respective product thickness would result. This would, in turn, result in changes to settings of a folding unit, which is typically positioned downstream from the printing press, for example.

The material supply system then determines the number of partial webs that will be required to make up the calculated length of the web of material, preferably based upon information pertaining to rolls which are present in the main storage facility or in the daily storage facility. Such information is available, for example, in the memory of the material supply system. These partial webs may, in some cases, have differing lengths. The material supply system then lines up the selected partial webs in such a way that the last partial web has a defined minimum length. This defined minimum length is dependent at least upon the cycle period which will be required to prepare a partial web that is required to continue the current production run. Thus, in a first step, those rolls are selected, from the total number of rolls present in the main storage facility and/or the daily storage facility, are suitable for executing the impending print order. The selected rolls are then intermediately stored in the daily storage facility, for example. In a subsequent step, these selected rolls are fed from the daily storage facility, for example, to the roll changer in a sequence, such that at least the aforementioned condition, with respect to the last roll to be used in executing this print run, is fulfilled. At the end of the print run to be printed, the last partial web can be consumed completely, with respect to its usable length, under the given conditions of use. As a rule, this last partial web still has a residual length that is not equal to zero. This remaining residual length of the last partial web is separated from the web of material that has been imprinted in the printing press, at the end of the executed print run, for example by actuating a cut-off blade. Furthermore, the residual roll belonging to this last partial web is automatically unloaded, or removed, from the axis of the roll changer. Following an automatic or a manual intervention, which may involve preparation of an adhesive or the like, for example, this partial roll is again placed in storage, and preferably is placed automatically in the daily storage facility, for example, if it can be reused under the stated conditions of use. Ordinarily, partially consumed rolls are stored only in the daily storage facility. If the usable length of a last partial web has been consumed completely, the core of this roll is preferably automatically removed from the area of the roll changer. One condition for a renewed use of a residual roll may consist, for example, in that it must still have a certain minimum diameter, so that it can again be automatically uploaded by the roll changer during a later production run. This minimum diameter can range from 100 mm to 250 mm, for example, and is generally dependent upon the structural conditions of the transport system which is used to transport the respective roll.

In calculating the total length of the web of material that is required for the continuous production of a certain print run of a specific print product, the material supply system takes into account the number of copies of wasted paper that are produced, based upon experience. This number can be determined by adding a percentage, or by adding a fixed number of copies to each desired product run, either automatically or via a manual input or selection, such as for example, as can be done at a control station on the printing press or at the control unit of the material supply system. For a print run of 65,000 copies of printed product to be produced, for example, 2,000 projected wasted copies can be planned for. For a print run of 90,000 copies of the printed product to be produced, for example, 5,000 wasted copies can be planned for. Furthermore, in practice, a reserve in the amount of a certain percentage of the planned product run, or in the amount of a certain number of copies, such as, for example, 3,000 copies, is also included in calculations, by which the desired product run is increased in each case. The number of wasted copies and/or the number of reserve copies can be variably set at the control unit of the material supply system, for example, and can be adjusted based upon the amount of the product run and/or the nature of the printed product. From the total number of products, and comprised of the actual product run plus the wasted copies and also plus the reserve copies, the total length of the web of material, which will be required for a continuous production of this total number, is determined based upon the given configuration of the printing press to be used. The configuration of the printing press takes into account, for example, the circumferential size of the cylinders of the printing press which are used in the printing process and the nature of the loading of these cylinders with print images. It also considers the various production types, such as non-collect or collect production, and the number of pages in the copies of the printed product to be produced.

The present invention is directed to devising a method for supplying a web of material of predetermined length to a printing press for producing a printed product. A plurality of partial webs, at least some of which are of different lengths, are used to make up the length of the web of material. These partial webs are used in such a way that the current production run is ended in a defined manner with the last of these partial webs upon completion of the print run to be printed.

The object is attained in accordance with the invention with the determination of the length of the web of material being based at least on a print run of the printed products to be printed continuously. The web of material is comprised of a plurality of partial webs which are joined in a line, in succession. Some of these webs are of differing lengths then others. These partial webs are supplied to the printing press under the control of a material management system which includes a control unit and which controls a storage facility with a plurality of partial webs. The control unit determines the demand for partial webs, with respect to the length of the web of material to be printed based on production data in a production planning system.

The benefits to be achieved in accordance with the present invention consist especially in that the current production run can be ended, in a defined manner, with the last partial web, which was selected in a specific manner. Of the plurality of partial webs of different lengths, the partial web which is the one used last, has a minimum length. The minimum length of the last partial web is determined based upon a transport speed of the web of material. An end of the production run to be completed with this last partial web is reached at the earliest when a cycle period has elapsed. The cycle period is a period of time during which a web of material, or one of its constituent partial webs, is prepared for its respective use in the printing press. With this selection and determination of the sequence of partial webs belonging to the same web of material to be imprinted, an optimal utilization of the available partial webs is ensured. The control unit of the material supply system accordingly makes selections from the quantity of rolls it controls, automatically, such as, for example, via program control, using the production data available to it, and places these rolls in sequence. Of the rolls that have been selected, the aforementioned condition is fulfilled in the last roll used. This automation assists the press operator of a print system. Potential errors, which could interfere with a problem-free running of the press, and a transition between successive production runs, are prevented by a purposefully automated processing of unambiguous, previously established criteria.

The method in accordance with the present invention also enables the implementation of an automatic transition, from a first web of material to be imprinted in the ending first production run, to a second web of material to be imprinted in the subsequent second production run. The webs of material differ from one another in terms of their respective widths and/or the grade and/or the base weight of their material, for example. This automatic transition can be made within a minimal setup time, and in some cases can even be made without stopping the web-fed printing press. The second web of material is reliably provided to the web-fed printing press at the proper time and near the end of the first production run, and is introduced into the production process. A preventive holding of a so-called "backup roll" in reserve, to ensure completion of the production run, can be dispensed with, thereby eliminating steps that are not absolutely essential to the production run. The methods in accordance with the present invention also contribute to optimizing an inventory from which the web-fed printing press is supplied with the respective web of material.

BRIEF DESCRIPTION OF THE DRAWINGS

One preferred embodiment of the present invention is represented in the accompanying drawings and will be described in greater detail in what follows. The drawings show.

DESCRIPTION OF THE PREFERRED EMBODIMENT

Figure 1:
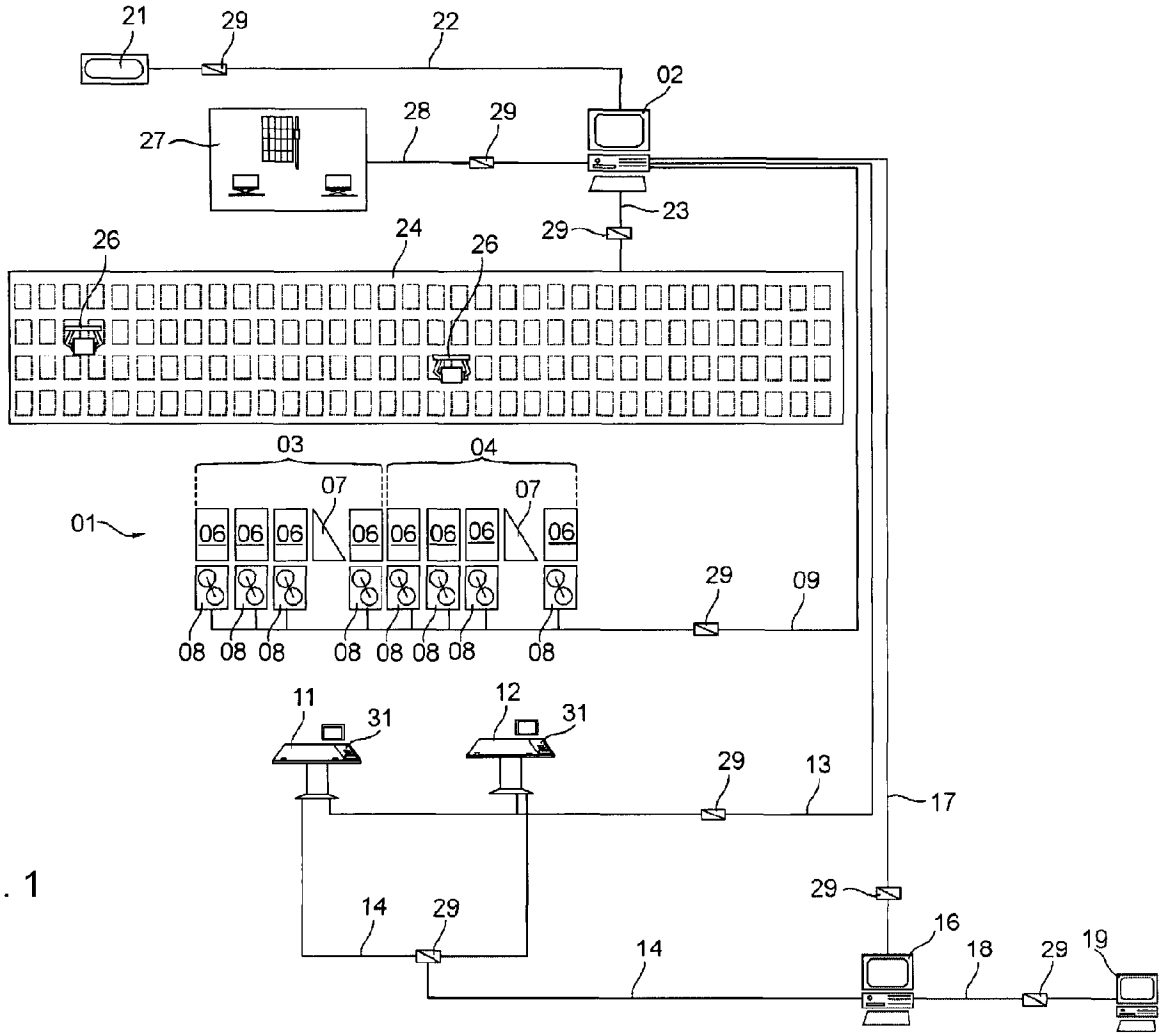
FIG. 1 a block diagram, schematic depiction of a print shop with at least one printing press and a material supply system.

FIG. 1 shows, in a simplified block diagram, a schematic depiction of a print shop, with at least one printing press 01 and with an electronic control unit 02 of a material supply system. The printing press 01 is preferably configured as a web-fed printing press 01, for example. It comprises a plurality of press sections 03; 04, for example two, which press sections 03; 04 are capable of production independently of one another. Each section 03; 04 preferably has a plurality of printing towers 06, for example four such printing towers 06, and at least one folding unit 07. Each printing tower 06 is preferably assigned an automatic roll changer 08. Each roll changer 08 can simultaneously support two rolls of a print substrate to be supplied to the respective printing tower 06, namely a first roll, with a first print substrate which is already being used in a production run currently underway in the printing press, and a second roll, with a second print substrate which is prepared to be used in the production run as soon as the print substrate from the first roll has been consumed. Each roll forms a partial web. The roll changer 08 is equipped with a device for use in automatically connecting the first or present partial web of the roll already being used in the current production run with the second or subsequent partial web of the roll which is to continue the production run. This device of the roll changer 08 which connects the partial webs to one another is configured in its preferred embodiment, as a gluing device. Each of the roll changers 08 has a control unit, which is connected to the control unit 02 of the material supply system via a control line 09 for the purpose of executing a data exchange. Preferably, each press section 03; 04 is assigned a press control unit 11; 12, which is preferably configured as a press control station 11; 12. The respective press section 03; 04 or even the entire printing press 01 can be controlled from each of these press control stations 11; 12. The press control stations 11; 12 are also preferably connected to the control unit 02 of the material supply system via a control line 13. Each of the press control stations 11; 12 also has an operating unit 31, for example, with a display unit, wherein data, and especially production data relating to the respective print order, can be input manually, or can be selected from a list of choices, for example, at the operating unit 31. The display device belonging to the respective press control station 11; 12 can also be configured as a so-called touch screen. Such a touch screen is an input device that is known in the field of computer technology and is configured as a touch screen or sensor screen. A selection or even an input can be made directly on this display device, because functions of the operating unit 31 are integrated into the display device. The production data, which is made available to the press control station 11; 12 that controls at least the current production run of the first print product, can preferably be added to and/or corrected during the current production run of the first printed product via a manual input into the operating unit 31 belonging to this press control station 11; 12, so that changes and/or corrections can be taken into account, as needed. The press control stations 11; 12 are preferably also connected to one another for data transfer via a control line 14, wherein this control line 14 is preferably also connected to an electronic control unit 16 of a production planning system. The control unit 16 of the production planning system is connected to the control unit 02 of the material supply system via a control line 17. The control unit 16 of the production planning system can also be connected to a control unit 19 of an operating data acquisition system via a control line 18. In the case of a manually controlled main storage facility, at least one monitor 21, for displaying roll requirements, and preferably also one operating unit, for example, for inputting and/or selecting data, especially production data, are connected to the control unit 02 of the material supply system via a control line 22. The control unit 02 of the material supply system is also connected via a control line 23 to control and adjustment devices of a daily storage facility 24 assigned to the printing press 01. These control and adjustment devices operate at least one transport device 26 that works in the daily storage facility 24, for example, and control the sequence of movements of this transport device 26. The transport device 26 that operates in the daily storage facility 24 can be embodied as a driverless transport system (AGV), for example. Preferably, the daily storage facility 24 is also controlled by the material supply system.

A roll preparation station 27 for use in preparing the rolls is provided. Rolls that have been taken from the main storage facility are prepared for use in a printing process in the roll preparation station 27, and then are intermediately stored in the daily storage facility 24. In the case of an automatically controlled main storage facility, the respectively required roll is automatically supplied to the roll preparation station 27 by the material supply system. The preparation of the rolls, which is performed in the roll preparation station 27, especially includes preparing these rolls for a splicing process to be performed in the roll changer 08 at a later time. Rolls prepared in the roll preparation station 27 are therefore also called splice-ready rolls. A splice-ready roll is to be introduced into the printing process within between 24 and 72 hours, for example, with this time depending upon the usable life of the adhesive preparation. A control unit located in the roll preparation station 27 for preparing the rolls is connected via a control line 28 to the control unit 02 of the material supply system. The control unit of the roll preparation station 27 is preferably equipped with an operating unit and a display device, neither of which is specifically depicted in FIG. 1.

All of the control lines 09; 13; 14; 17; 18; 22; 23; 28 can also be embodied as wireless transmission links, and/or can preferably be part of the same communications network, such as, for example, an Ethernet based network. One or more devices 29, which each control and/or monitor data traffic, can be positioned in all of the control lines 09; 13; 14; 17; 18; 22; 23; 28. Each such device 29 is embodied as an interface 29 which allows bidirectional data transmission, for example. The networking of all system components described above in reference to FIG. 1, i.e., and especially their control units 02; 11; 12; 16; 19, via the control lines 09; 13; 14; 17; 18; 22; 23; 28 makes it possible for data to be exchanged between at least one of the control stations 11; 12 and the production planning system and/or the material supply system, and/or to be transferred from the respective roll changer 08 directly to the material supply system.

Based upon preset data in the production planning system, the control unit 02 of the material supply system causes rolls of print substrate, that are suitable for executing a specific print order, to be held in reserve in the daily storage facility 24 and to be transported to the respective roll changer 08 at the proper time. The control unit 02 of the material supply system also controls the sequences required to execute a specific print order, such that the rolls of print substrate, which are selected from the daily storage facility 24 and/or from the main storage facility, for example, are used in a purposeful manner such that the production run to be executed is completed in a defined manner with the last roll to be used at the end of the run to be printed. The established sequence of rolls to be imprinted, as determined by the control unit 02 of the material supply system, is primarily based upon the minimum length of the partial web on the last roll to be used, calculated for the defined completion of the production run. The determination of the minimum length preferably also takes into account the planned transport speed of the web of material to be printed in the printing press. The data connection of the control unit 11; 12 of the printing press 01 with the control unit 02 of the material supply system and/or with the control unit 16 of the production planning system especially makes it possible for a time for the formation of a connection between the second web of material and the first web of material to be determinable and to be determined by the press control unit 11; 12 which controls at least the current production of the first printed product, i.e., generally by one of the press control stations 11; 12. This determination is made based upon production data which is made available to this press control unit 11; 12 via a manual input into an operating unit 31 that belongs to the press control unit 11; 12, or automatically by the control unit 16 of the production planning system.

Figure 2:
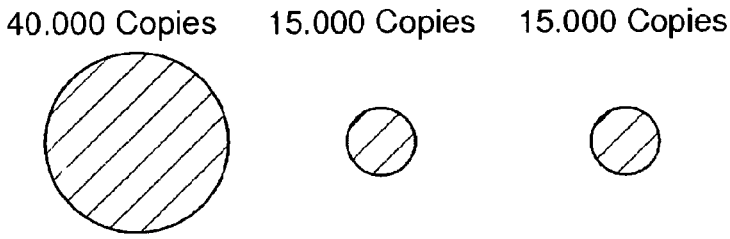
FIG. 2 to 6 first examples of rolls of material selected for the production of a specific print product.
Figure 3:
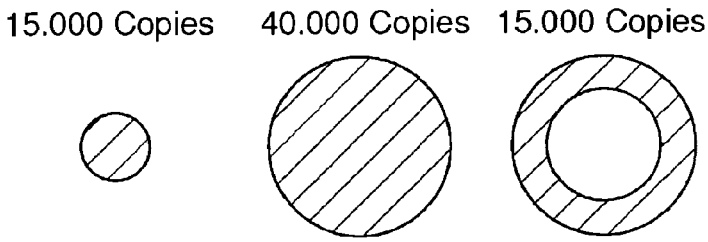
Figure 4:
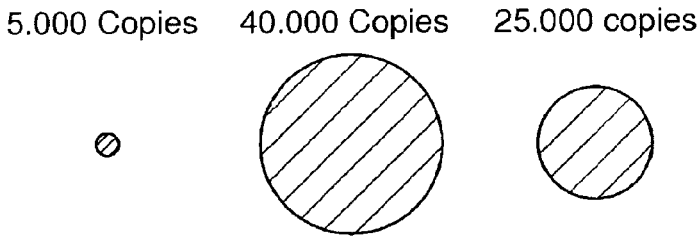

For rolls that are to be imprinted, the following examples of configurations may be used in the selection and sequence of rolls to be used:

In a first example, a run of the printed product comprising 65,000 copies is assumed. Another 5,000 copies are included in the plan as projected waste copies and as reserve copies accordingly, rolls are selected with which a total of 70,000 copies can be produced. With a cycle period of 420 seconds given in this example, and taking into account a certain configuration of the printing press 01, it is determined that at least 14,300 copies will have to be produced from the last roll to be used. The control unit 02 of the material supply system selects three rolls for executing this print order, for example. FIG. 2 through 4 each show an allowable selection and sequence for the selected rolls.

As depicted in FIG. 2, production is started using a roll whose partial web is sufficient for printing 40,000 copies of the current print order. Two smaller rolls such as, for example, partial rolls, are then used, each of whose respective partial webs are long enough for the production of 15,000 of the copies to be printed. The last of these three rolls is also fully consumed with respect to its usable length in the execution of this print order, so that it is necessary only to remove its core from the roll changer 08. The partial rolls, i.e., the two smaller rolls, can each be residual rolls from a previous production run, for example.

Figure 5:
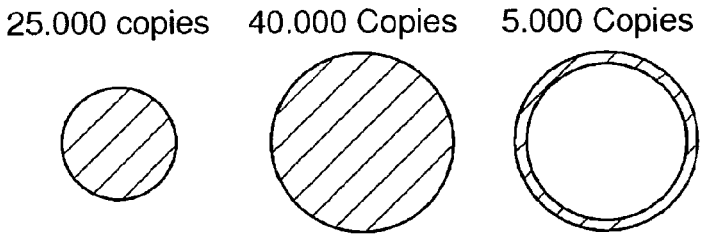
Figure 6:
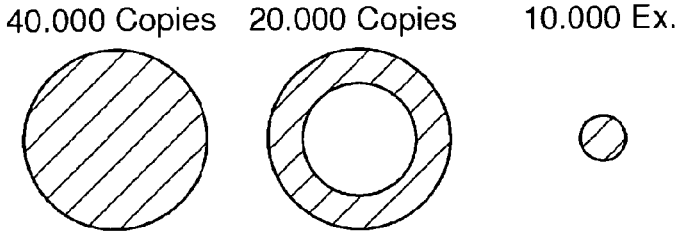

The amount of the respective partial web, that is consumed in the printing process, is indicated in FIGS. 2 through 6 by hatching in the respective roll. In FIGS. 3, 5 and 6, a white cross-sectional surface indicates the respective residual roll, i.e., the amount of partial web remaining, which is not used in the current production run.

In accordance with the depiction of FIG. 3, production is begun using a partial roll, for example, whose partial web is sufficient to print 15,000 copies. Two new rolls, each having sufficient length of their respective partial webs to print 40,000 copies, are then used in succession, Only 15,000 copies are produced using the last roll. Thus, a greater residual length of the partial web remains on the last roll, so that this roll is removed from the roll changer 08 upon completion of the production run, and is returned to the daily storage facility 24, for example. The current diameter of this last roll is greater than the required minimum diameter that must be present for this roll to be reused in an automatic roll change.

In the embodiment shown in FIG. 4, production is started using a small partial roll, which is consumed after printing 5,000 copies of the current print order. After that, first a new roll is used, whose partial web is sufficient for 40,000 copies in the current production run. A partial roll is then used, with which the remaining 25,000 copies can be printed. The usable length of this last partial roll has then been fully consumed, so that again, essentially all that remains is to remove its core from the roll changer 08. In the represented example, as was the situation in the example of FIG. 2, it is assumed that the copies included in the plan as reserve copies have also all been printed. If at least some of the copies included in the plan as reserves are not printed, a residual roll would remain. It would be necessary to return such a residual roll to storage if its remaining current diameter was greater than the minimum required diameter.

The embodiment shown in FIG. 5 is similar to the configuration depicted in FIG. 3. However, at the start of production a partial roll which is sufficient to print 25,000 copies is used. At the end of the current production run, only another 5,000 copies need to be printed using the new roll. However, 5,000 copies are printed within a shorter time than the cycle time, so that once these remaining copies needed to complete the print order have been printed, the printing press 01 will necessarily become idle. For a continuous transition to a subsequent production run at the given speed profile for the transport of the web of material, it would be necessary for the printing press 01 to print a total of at least another 14,300 copies from the last roll used. This is not the case in the configuration depicted in FIG. 5. The selection and sequence of the rolls used in FIG. 5 is disadvantageous and accordingly should therefore be avoided.

The roll configuration which is depicted in FIG. 6 is also highly unfavorable and would not allow for performing a continuous transition to a subsequent production run. In this depicted roll configuration, a new roll is first completely consumed in the printing of 40,000 copies. After that, only 20,000 copies are printed, also from a new roll. This second new roll is therefore only half consumed. A partial roll is then used in this example, the usable partial web length of which is sufficient for printing only 10,000 copies. After this, the usable length of this last partial roll is completely consumed. This production plan should be avoided because it is not favorable to connect a partially consumed roll such as the middle roll, from which only 20,000 copies are printed, to the partial web of a subsequent roll at the given, preferably maximum transport speed for the web of material. A rotating paper tab of that partially consumed roll, which would be uncontrollable, at least in the roll changer 08, would remain on the rapidly rotating residual roll. Such an uncontrollable rotating paper tab could cause serious problems in the current production run.

Figure 7:
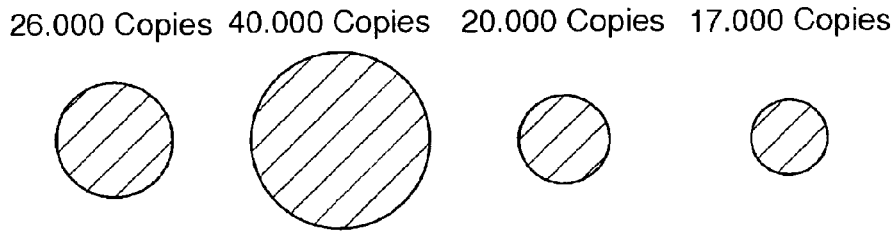
FIG. 7 to 11 second examples of rolls of material selected for the production of a specific print product.
Figure 8:
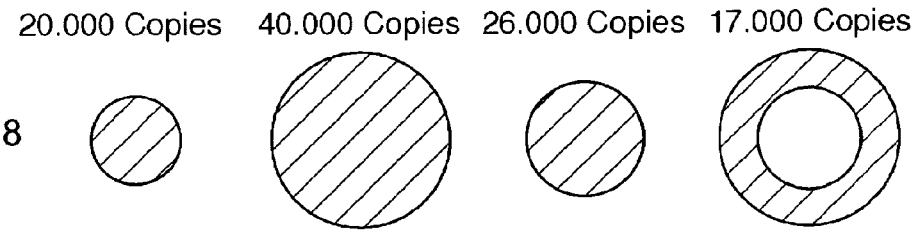
Figure 9:
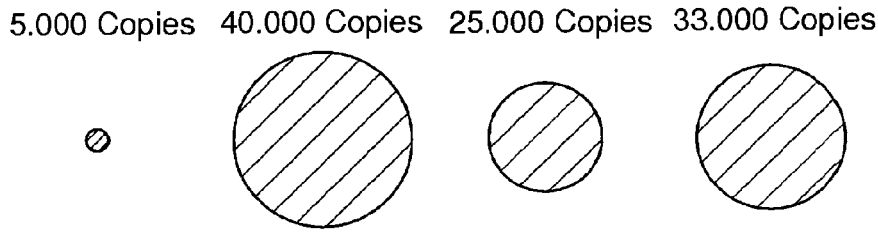

In FIG. 7 through 11, a second example of the production of a printed product is shown. A run of the print product comprising 95,000 copies is assumed, to which an additional 8,000 copies are added as projected waste copies and reserve copies. In each of the configurations shown in FIG. 7 through 11, four rolls are selected by the control unit 02 of the material supply system and are made available in sequence for the production run corresponding to the print order. With their combined partial webs, a total of 103,000 copies can be produced from these four rolls. With a cycle period of 420 seconds, viewed as given, and taking into account a certain configuration of the printing press 01, it is determined that the last roll to be used must be sufficient to print at least another 16,750 copies. FIG. 7 through 9 each show an allowable selection and sequence for the rolls selected by the control unit 02 of the material supply system.

According to the roll configuration of FIG. 7, production is begun with a partial roll for 26,000 copies. This is followed by a new roll for 40,000 copies. Afterward, first a partial roll is used for 20,000 copies and then a partial roll is used for 17,000 copies. The usable length of the latter partial roll is completely consumed in this current production run, for example, even if the copies included in the plan as reserves have all been printed. Otherwise, a residual roll remains, which must be returned to the daily storage facility 24 or to the main storage facility if its remaining current diameter is greater than the requisite minimum diameter.

In the roll arrangement shown in FIG. 8, at the start of production a partial roll is used for 20,000 copies, and then a new roll is used for 40,000 copies, which is followed by a partial roll for 26,000 copies. To complete the current production run, a new roll, with a capacity of 40,000 copies, is again used. Only 17,000 copies are printed from this new roll however, so that more than half of the partial web remains on this roll.

In the roll arrangement shown in FIG. 9, at the start of production a partial roll is used for only 5,000 copies, followed by a new roll for 40,000 copies and two partial rolls. The first partial roll is sufficient for 25,000 copies and the second partial roll is sufficient for 33,000 copies. Assuming that the copies, which have been included in the plan as reserve copies, have also all been printed, the usable lengths of all the rolls used in this production run are fully consumed. Otherwise, a residual roll will also remain in this configuration, which residual roll must be returned to the daily storage facility 24 or to the main storage facility if its remaining current diameter is greater than the requisite minimum diameter.

Figure 10:
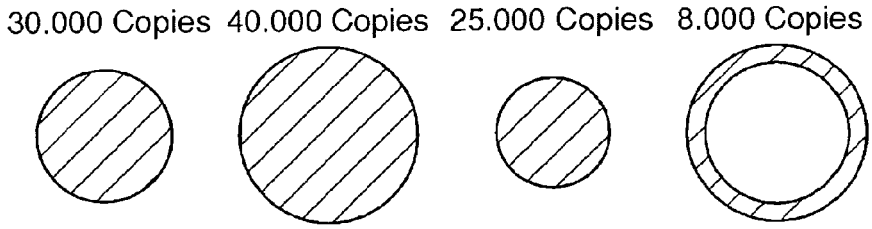
Figure 11:
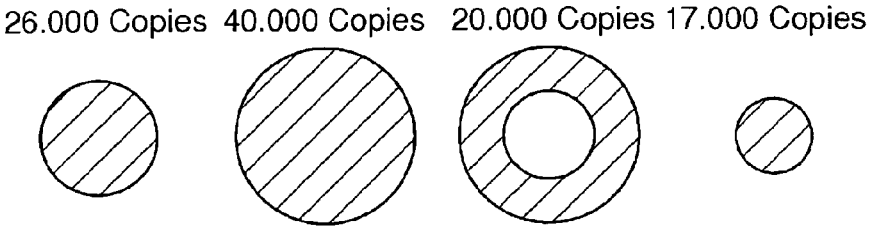

FIGS. 10 and 11 show unallowable configurations. In the configuration of FIG. 10, production begins with a partial roll for 30,000 copies. This is followed first by a new roll for 40,000 copies and then a partial roll for 25,000 copies. To complete the current production run, only another 8,000 copies need to be printed. However, at the given speed profile for the transport of the web of material, this printing will occur within a shorter time than the current cycle time. This configuration is unfavorable, regardless of the nature of the last roll used, i.e., regardless of whether a partial roll, or, as shown here, a new roll that is sufficient for 40,000 copies is used as this last roll.

In the roll configuration depicted in FIG. 11, production is begun using a partial roll for 26,000 copies. Two new rolls, each sufficient for 40,000 copies, are then used in sequence. The intent is to use only half of the last of these rolls, and to complete the current production run using a partial roll for 17,000 copies, so that the usable length of this partial roll is fully consumed. This last roll configuration is unfavorable because it requires the partial web of the last partial roll to be connected to the partial web of the new roll that has been only half consumed while production is ongoing, i.e., preferably at the maximum transport speed of the web of material. This is not possible, however, due to the formation of a paper tab on the residual roll which has been only partially consumed, but which residual roll continues to rotate rapidly in the roll changer 08. Therefore, only a partial web whose usable length has been completely consumed can ever be joined to another partial web to be used in the same production run.

Figure 12:
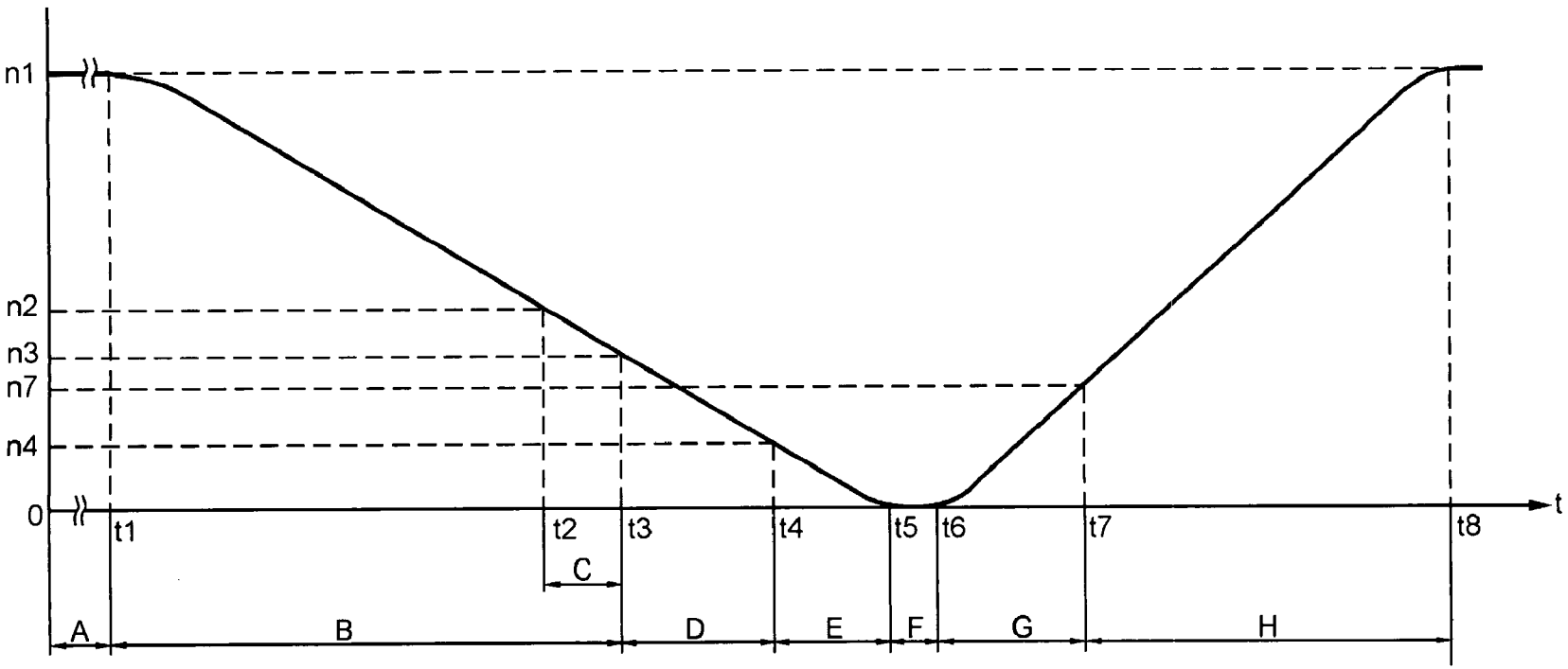
FIG. 12 a diagram showing a sequence, over time, for a process of resetting the printing press to execute a different production run.

FIG. 12 shows, by way of example, a diagram of a sequence, over time, of a resetting of a web-fed printing press 01 from a current production of a first printed product to a subsequent production of a second printed product. This resetting is intended to enable the execution of an automatic transition from a first web of material being imprinted in the production run that is ending, and having, for example, a first width, to a second web of material to be imprinted in the subsequent production run, and having a second width, wherein these two web widths differ from one another. A transition, from a production run that is ending, to a subsequent production run, can also or can alternatively involve a change in the grade of substrate, especially the paper grade, and/or in the base weight of the print substrate. Even if the base weight remains the same, a print substrate, and especially a paper, can have differences of 20% or more, for example, in its web thickness, depending upon its grade. Thus, it may also be necessary to reset the web-fed printing press 01 if, in a subsequent production run, a web of material of a different grade, as compared with the preceding production run, is to be used. In the diagram shown in FIG. 1, the production speed of the printing press 01, as indicated by the number "n" of revolutions of the printing cylinder per hour, is recorded over the time t. The example shown in FIG. 12 assumes that the same printing couple, which is located in one of the printing towers 06, is used for both the first and the second production run.

In the diagram, a first section A, which is here shown shortened, indicates that, in a first production run shown, the printing press 01 runs at its preferably maximum production speed n1. The production speed n1, referred to the rotational speed of the printing cylinder, is 40,000 revolutions per hour, for example. Once the period of time characterized as section A has elapsed, the at least one control unit 11; 12 of the printing press 01 initiates its slowdown at time t1, for example. The production speed n1 is continuously reduced after the time t1, because the current production run, i.e., in this example the first production run, is nearing completion. In the example shown in the diagram of FIG. 12, a second section B begins at time t1. By the end of the time period characterized as section B, which time period extends up to a time t3, at which time the printing press 01 preferably has a production speed n3, which is reduced in relation to the production speed n1, and ranging only between 5,000 and 7,000 revolutions per hour, for example, the control unit 02 of the material supply system, preferably in response to an initiation by the control unit 16 of the production planning system, provides a new roll of print substrate, taken from the daily storage facility 24, for example, to the roll changer 08 which is being used in the current first production run and which will be used in the subsequent, second, or new production run. Taking into account the above-described cycle period, however, the preparation of a roll, which will be required for the new production run, preferably begins prior to time t1. In an alternative embodiment, the preparation of the roll, that will be required for the new production run, has already been completed by time t1. The preparation of the roll, which is required for the new production run, includes the roll changer 08 being brought, by its control unit to an uploading position, for example by a pivoting of its parallel support arms and by an adjustment of the distance between those support arms. In this position, the roll changer 08 holds the roll provided on it and then accelerates this roll's circumferential speed to the level of the transport speed of the web of material currently being imprinted in the printing press, as determined by the already reduced production speed.

If a material roll has been provided for the new production run, whose web of material is narrower than the width of the web of material in the production run that is still underway, for example, then within the time period characterized as section B a washing process, represented in FIG. 12 as section C, can be provided for the printing couple cylinders being used in the current production run, such as, for example, the transfer cylinder and the forme cylinder of the printing couple of the printing press 01, and also for the ink transporting rollers of an inking unit assigned to the respective forme cylinder. Such a washing process, which preferably ends at time t3, begins, for example, at a time t2, at which time t2, the printing press 01 preferably has a production speed n2 of only 7,000 revolutions per hour, for example, which is reduced in relation to the full production speed n1. By time t2, and even before the washing process is initiated and is triggered by a control command from the control unit 11; 12 of the printing press 01, which is controlling the still current production run, a supply of ink to the printing couple cylinders is adjusted. The washing process, which is also called a run-out wash and which begins at time t2, can last between 2 and 3 minutes, for example.

This washing process, which is preferably accompanied by a free running of the printing couple cylinders and, especially in the case of a dry offset printing process, by the running of the inking units free of ink, is the for use with a resetting of the printing press 01 to perform an automatic transition from a first web of material, having a greater first width, and which is to be imprinted in the production run that is ending, to a second web of material, having a narrower, second width, to be imprinted in the subsequent production run. Otherwise ink that will remain in the printing couple will impair the subsequent printing process. In resetting the printing press 01 from one production run, involving a first web of material having a narrower first width, to a subsequent production run, involving a second web of material having a comparatively greater second width, the free running of the printing couple cylinders and the inking units and the washing process are also recommended. However, these may also be optionally omitted. By the end of section C at the latest, at which time a free running of the printing couple cylinders and, if applicable, also the inking units preferably occurs, the printing couple cylinders, which have been executing the printing, are disengaged from the first web of material.

In a subsequent time period, which follows time t3, and which is represented in the diagram as section D, and at a time that is established by a control unit 11; 12 which controls at least the current production of the first printed product, such as, for example, by one of the control stations 11; 12, and triggered by a corresponding control signal, a leading edge of the second web of material, which second web of material has been provided for the subsequent production run, is preferably connected, for example via a splice, to the first web of material, which is still being imprinted in the currently ongoing production run. Such a connection, which is preferably produced via splicing, occurs after the roll with the second web of material, and which has been received by the roll changer 08, has been accelerated, in terms of its circumferential speed, to the current level of the transport speed of the first web of material. The formation of the connection of the second web of material to the first web of material forms a point of attachment, preferably a splice, whose path of travel through the printing press 01 can be monitored. The point of attachment between the first web of material and the second web of material is preferably formed at the end of the usable length of the second web of material, for example by a connecting device which is located in the roll changer 08. The point of connection between the first web of material and the second web of material traverses a distance extending from the roll changer 08 at least to the folding unit 07, at a defined transport speed. The length of this path of travel is calculated on the basis of the structural circumstances in the printing press 01, or is determined metrologically. The time which is required to traverse this distance is stored in a database, for example, and can be referred to in the event of a later identical or a similar change in production to determine the time at which a change in a setting, for example in a width of the gap between folding jaws of the folding unit 07, should be started in order to reset the folding unit 07 from the previous production of the first printed product to the subsequent production of the second printed product. After passing through the folding unit 07, the point of attachment between the first web of material and the second web of material is diverted, on its way from the folding unit 07 to further processing, which diversion is performed subsequent to printing in the production process, to a waste paper sorter.

At the end of section D, which is characterized as time t4, the production speed n3 of the printing press 01, which at time t3 has already been reduced to 5,000 to 15,000 revolutions per hour, for example, preferably to 5,000 to 7,000 revolutions per hour, especially to approximately 5,000 revolutions per hour, has decreased further to a production speed n4 having a value of between 2,000 and 3,000 revolutions per hour, for example. Once the connection or the splice has been made, the first web of material is separated from its roll. This first web of material is cut off from a residual amount of this print substrate that is still remaining on the roll by a cross-cutting device, such as, for example, by a cut-off blade. The cross-cutting device is actuated by the control unit of the roll changer 08, for example. After the cutting of the first web, the circumferential speed of the residual roll, that is remaining from the currently ongoing production run, is then slowed to a stop in the roll changer 08.

In a subsequent time period, which follows time t4, and which, in the diagram, is represented as section E, the leading edge of the second web of material which is intended for the subsequent production run, is drawn by the first web of material through the relevant printing tower 06, at least up to the location of a turning device which is preferably positioned in the superstructure of the printing press 01. In addition to having a plurality of turner bars, the turning device comprises a plurality of cutting devices, which may be, for example, arranged side by side, extending transversely to the direction of transport of the web of material, and acting longitudinally in relation to the direction of transport of the web of material. Through the use of these cutting devices, the respective web of material can be divided into a plurality of ribbons that can be processed individually. These cutting devices, which are configured, for example, as rotary blades that can be engaged against the respective web of material, are also called longitudinal cutters. In the example shown in FIG. 12, the splice that connects the two webs of material to one another reaches the longitudinal cutters in the turning device at the end of section E at time t5. At time t5, which is at the start of a section F, which follows section E, as depicted in FIG. 12, the production speed n5 of the printing press 01 is reduced to zero, for example, thus causing the two webs of material, which are now connected to one another, to come to a halt. The splice, which is moved by the transport of the webs of material, therefore stops preferably directly in front of the longitudinal cutter, or in its area of operation.

In the case of resetting from a production run involving a web of material of greater width to a production run involving a web of material of narrower width, a free ribbon forms on the wider web of material once the splice has passed the longitudinal cutter. This free ribbon, or in other words, this ribbon which is no longer advanced by the print substrate, must be removed from the printing press 01. This is because a web tension, which is necessary for the web's further processing, can no longer be maintained on it. In the case of resetting from a production run involving a web of material of narrower width to a production run involving a web of material of greater width, at least one additional cutting device must be activated in the longitudinal cutter, for example, in order to form at least one additional ribbon that will be separated from the wider web of web of material with respect to the new production run. It may also be necessary to guide this at least one additional ribbon over at least one additional turner bar before it is also processed in the folding unit 07. The above-discussed idle status of the printing press 01 in section F, in which, after time t5, the production speed n5 is reduced to zero, for example, is necessary only if an additional ribbon is to be introduced into the folding unit 07 and is to be processed there in the new production run. Otherwise, the resetting of the printing press 01 and its folding unit 07, from the current production of the first printed product to the subsequent production of the second printed product, can also be accomplished without placing the printing press 01 in an idle state. However, the respective ribbon width preferably is not changed between the preceding production run and the subsequent production run. Accordingly, in the resetting, only the number of ribbons that are formed from the respective web of material can be changed, for example. If, alternatively or additionally, the respective ribbon width is nevertheless to be changed for the new production run, the cutting devices that are still engaged on the web of material for the previous production run are temporarily disengaged until the start of the new production run, and are then repositioned before being returned to use. Before the new production run is started, the cutting devices must also be cleared of cutting scrap resulting from the previous production run, if applicable, and any soiling must be removed. It is also possible that a ribbon of one of the webs of material can be divided into a plurality of different partial ribbons by cutting devices which can be engaged against the web of material, and that this plurality of different partial ribbons from the same ribbon, which will be processed to the same printed product, are supplied to the same folding unit 07 at the same time.

By the time section F, which begins at time t5, has elapsed, and during which time section the printing press 01 is idle, for example, or at least during which time the transport speed of the two webs of material connected to one another has been reduced to zero, the folding unit 07, which will process the relevant web of material or its respective ribbons once these have passed through the printing tower 06, is set up for the new production run. To accomplish this setting up of the folding unit 07, either the new web of material, in which either the width of which is different from that of the preceding production run, or the number of ribbons that are to be formed from the new web of material, which new number of ribbons is different from the number of ribbons of the preceding production run, are fed into the folding unit 07 at an infeed speed n7, which infeed speed n7 is preferably significantly reduced in relation to the full production speed n1. A width of a gap formed by folding jaws spaced somewhat from one another, with that width being adjustable on the folding jaw cylinder of the folding unit 07 and currently still set for the preceding production run, is adjusted to the new production run. This adjustment of the width of the gap between the folding jaws can be performed on the folding unit 07 either manually or preferably automatically via a servo device. Such a servo device may be controlled, for example, by one of the control stations 11; 12 belonging to the printing press 01, via a corresponding control command. The adjustment of the width of the gap between the folding jaws is necessary, especially when the shift in production will change the thickness of the copies of the printed product held by the folding jaws by a minimum amount, wherein this minimum amount is less than 1 mm, for example, and preferably is approximately 0.5 mm. Such a change in the thickness of the copies of the printed product can result, for example, if the number of pages of the printed product increases by eight or more, or if the grade of the second web of material has a greater web thickness, as compared with the web thickness of the first web of material. If the change in the product thickness, which product is held by the folding jaws, is substantial, for example if the number of pages in the product changes by 8, 10, 12 or more pages, it may be necessary to adjust the width of the gap between the folding jaws. This gap is set, in each case, to hold one copy of the first printed product. The gap adjustment may be required to be done in several steps of less than 1 mm each, for example, and especially may need to be done in steps of approximately, or of even less than 0.5 mm, for example, to adjust the gap to the width that is required to hold one copy of the second printed product.

The change in the setting of the width of the gap between the folding jaws is preferably initiated based upon the time for production of the connection of the second web of material to the first web of material and/or is based upon the transport speed of the connected webs of material. This time lies within the section D delimited in the diagram of FIG. 12 by times t3 and t4. Preferably, the change in the setting of the width of the gap between the folding jaws is begun once the second web of material has successfully been connected to the first web of material. The change in the setting of the width of the gap between the folding jaws can also be begun only after the point of connection between the second web of material and the first web of material, which point of connection is produced by connecting the second web of material to the first web of material, has reached at least the cutting device, which acts longitudinally in relation to the direction of transport of the webs of material, during its passage through the printing press 01. As has previously been mentioned, the change in the setting of the width of the gap between the folding jaws is begun, for example, only after the production speed of the printing press 01, with respect to its printing cylinder, has decreased from a level at which the first printed product is produced, to a reduced speed that is less than 7,000 revolutions per hour, or even after the cylinders of the printing press 01, which have executed the production of the first printed product, have come to a halt. The change in the setting of the width of the gap between the folding jaws is preferably completed before the first copy of the second product has reached the relevant gap between the folding jaws, in the sequence of the second printed product being obtained from the second web of material, and if the product thickness of the second printed product is greater than the product thickness of the previously produced first printed product. If the product thickness of the second printed product is less than the product thickness of the previously produced first printed product, the change in the setting of the width of the gap between the folding jaws is preferably completed only when the first copy has reached the relevant gap between the folding jaws, in the sequence of the second printed product obtained from the second web of material. The width of the gap between the folding jaws, which is set in each case to hold one copy of the first printed product, is advantageously adjusted in fewer than 30 seconds, by at least one drive which is provided in the folding unit 07, to the width required for holding one copy of the second printed product.

In addition to adjusting the width of the gap between the folding jaws, it may be necessary to readjust a cylinder gap in the folding unit 07. This requirement may result only from a change, in the number of pages, of 32 or more, for example, which change may be conditioned by the shift in production. In most cases, during the adjustment of the folding unit 07, the intake speed n7 must not exceed a threshold value established by the machine manufacturer. Otherwise, the folding unit 07 may be damaged, a jam may occur due to a gap between the folding jaws that is too narrow for the printed product, or the printed product that is normally held by the folding jaws of the folding unit 07 may be lost during its transport in the folding unit 07 because the width of the gap between the folding jaws is set too large. The maximum threshold level of the intake speed n7 at the reduced production speed n3, for example, is, at most, 15,000 revolutions per hour, and preferably is at most, 7,000 revolutions per hour, but particularly is set below this level, for example, at a maximum of 5,000 revolutions per hour. The infeed process shown in the diagram of FIG. 12 as section G begins at time t6 and ends at time t7. By the end of section G, the adjustment of the folding unit 07, and specifically its setup for the new production run, is completed. Such an adjustment of the folding unit 07 is only necessary, for example, because the product thickness of the second printed product deviates from the product thickness of the previously produced first printed product, at least by the minimum amount required for a change in the setting of the width of the gap between the folding jaws. The printing press 01 can now be accelerated back to its full production speed n1, which it reaches at the end of section H, which section H follows time t7, and terminates at time t8. Section H is also called the pre-print run. By this time, the printing couple cylinders, which are involved in imprinting the second web of material, are reengaged. Also, for example, at least one setting of the at least one inking unit and/or dampening unit, which is located in the printing tower 06, has been adjusted to the new production run. An adjustment, in response to the width of the second web of material width, which is different from the width of the first web of material, is also made. After this, and beginning at time t8, the production run which executes the actual new production is performed. Sections F and G, as shown in FIG. 12, together form a phase in which especially the folding unit 07 is adjusted to the new production run. The adjustment of the printing couple, which comprises the printing couple cylinders involved in the new production run, and the adjustment of the inking unit and/or dampening unit that is a part of this printing couple, can also, however, begin as early as time t5, for example. Once the adjustment of the folding unit 07 has been completed, the transport speed of the web of material can be reduced to zero for a short time, which short time is not specifically shown, before the pre-print run of this new web of material begins. If different printing couples will be used for the first production run and for the second production run, the adjustment of the printing couple, which will be involved in the second production run, and of the associated inking unit, and/or dampening unit can begin even before time t5. The adjustment of the printing couple can include the changing of one or more printing formes which are arranged on the forme cylinder. The adjustment of the folding unit 07 can also include changing the respective settings of infeed rollers, a lap device, folding rollers, a delivery fan, and/or a spur position. It may also be necessary to change the respective settings of at least one traction device which is used for maintaining web tension, such as, for example, a pretensioning unit and/or a drag roller and/or a bow roller. The inclination of a former and of a web alignment device may also require adjustment to the new production run. All of these changes to the settings of the press components that will be involved in the second production run are preferably made automatically and are triggered, for example, by the specific press control unit 11; 12 which controls the new production run, or in other words, by the respective press control station 11; 12.

As has been described above, at time t4, the splicing process has been completed in the roll changer 08 and the second web of material to be used in the new production run is starting to be fed into the printing tower 06 to be used in the second production run. Beginning preferably at time t4, but at the latest by the end of time t7, which end of t7 identifies the start of the pre-print run, the process of removing the residual roll from the previous, or first production run has been completed. The circumferential speed of this residual roll has been slowed to a halt. The residual roll is removed from the roll changer 08, and that roll, preferably as a splice-ready roll, is returned to storage in the daily storage facility 24, or in exceptional cases is placed back in the main storage facility. The splice preparation of the residual roll, which has been removed from the roll changer 08, is ordinarily performed manually in the roll changer 08 rather than transporting such a residual roll to the roll preparing station 27. A roll, that has been prepared for splicing in the roll changer 08, is placed in storage in the daily storage facility 24 especially when, in accordance with the data that is available in the production planning system, this roll can be reintroduced to a printing process within the period of time which is determined by the usable life of the adhesive preparation. By the time the residual roll has been removed from the roll changer 08, the material supply system ensures that a new roll is delivered to that roll changer 08. Such a new roll provides at least one additional partial web of the web of material which will be required for the newly initiated production run. This new roll, as described above, is taken up by the roll changer 08 and is introduced into the current production run. The leading edge of the web of material on the new roll is connected to the end of the web of material which is expiring from its exhausting roll in the currently ongoing production run, with the connection being preferably made by splicing. The provision of the new roll, and its preparation for printing, must be completed within the period of time determined by the production time for the roll with the currently expiring web of material, in order to ensure a continuous supply of print substrate to the printing press 01. The material supply system ultimately provides as many rolls of the respective print substrate in succession to the respective roll changer 08 as are required to realize a continuous flow of material in the respective production run, based upon the parameters set by the production planning system according to the above-described calculation.

Although the process steps which are necessary for resetting a web-fed printing press 01, from a current production of a first printed product to a subsequent production of a second printed product, have been described within the context of the example of a web-fed printing press 01 that has been slowed to a halt, with reference to FIG. 12, the profile of the production speed shown in FIG. 2 is not imperative. In another variation in accordance with the present invention, it may be provided that the production speed is not decreased from that of the current production run, or that the production speed is decreased only to the extent that a continuous transition from the production of the first printed product to the subsequent production of the second printed product is executed, all without bringing the web-fed printing press 01 to a halt. The decrease in production speed, from that of the current production run, is dependent upon whether an adjustment of the folding unit 07 to the new production run is necessary. It is also dependent upon the maximum transport speed of the second web of material at which this adjustment may be made.

Figure 13:
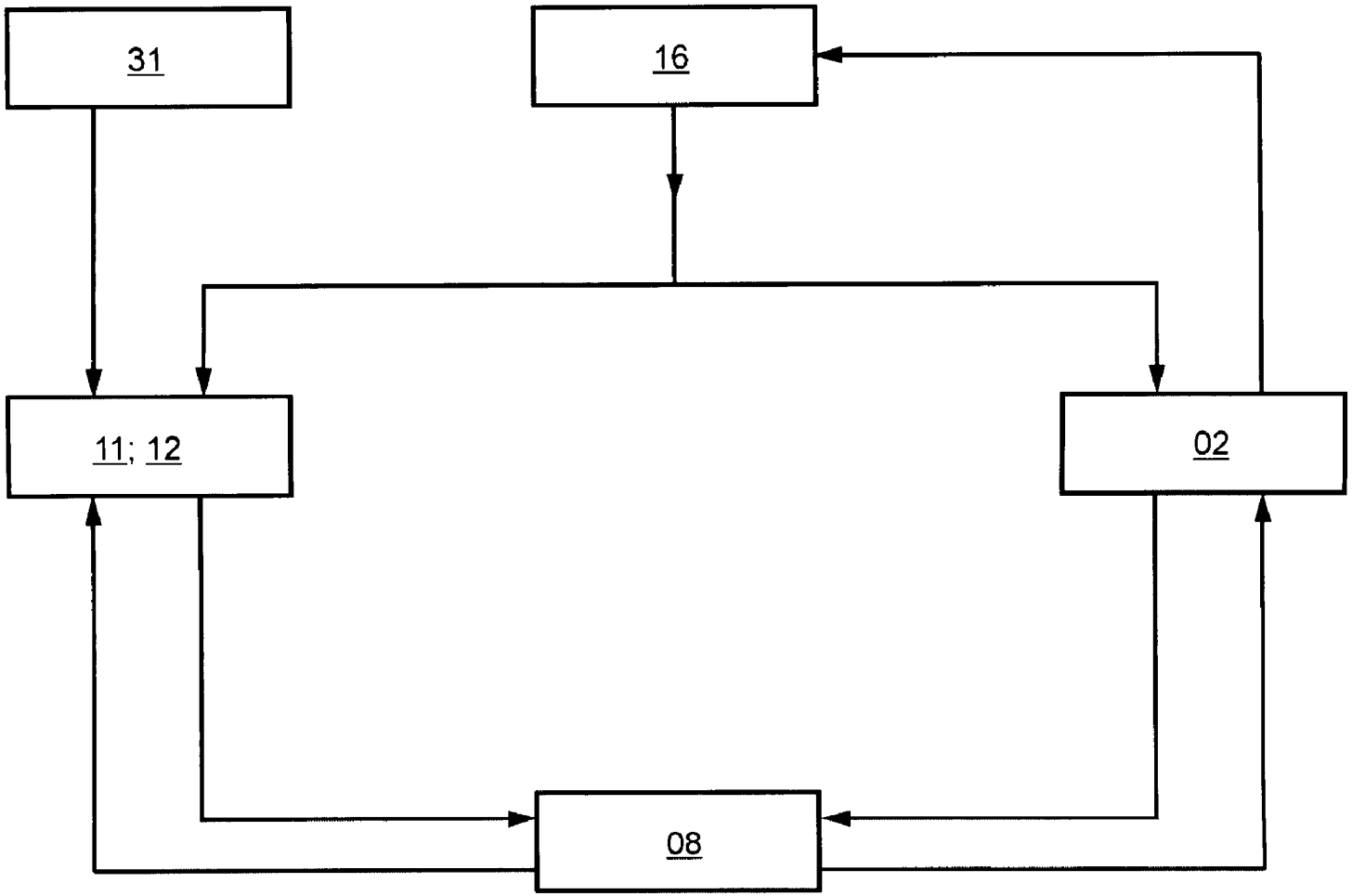
FIG. 13 a data flow diagram showing a control concept in accordance with the present invention.

FIG. 13 shows a simplified illustration of a flow of data between the components which are involved in the proposed control plan, and which are preferably networked with one another for data transmission. Each of the individual signal paths between these components, and including the direction of the respective data flow, is indicated by an arrow. The press control unit 11; 12 which controls at least the current production of the first printed product, and which is generally one of the control stations 11; 12 from which the printing press 01 is controlled, receives a set of production data belonging to a specific print order, either via a manual input into an operating unit 31 belonging to that specific press control unit 11; 12, or automatically from the control unit 16 of the production planning system. The control unit 16 of the production planning system is superordinate to the press control units 11; 12, to the control unit 02 of a material supply system, or is at least coupled to these. This production data contains, among other things, an indication of the number of copies of the printed product which are to be printed. The control unit 16 of the production planning system also provides the same set of production data, or at least provides a duplicate set of data having the same content, to the control unit 02 of the material supply system. Following the transmission and/or input of the respective production data, both the press control unit 11; 12 which controls at least the current production of the first printed product, and the control unit 16 of the production planning system each have at their disposal at least one set of production data, which at least one set of production data characterizes the first printed product to be produced, and a second set of production data which characterize the second print product to be produced. The control unit 16 of the production planning system can be connected to at least one additional computer system, which is not specifically shown here.

The press control unit 11; 12, which controls at least the current production of the first printed product, issues the control command to the control unit of the roll changer 08. Roll changer 08 is currently supplying the first web of material, for use in producing the first printed product, to the printing press 01. This control command instructs the roll changer 08 to connect the second web of material to the first web of material, which is currently being supplied to the printing press 01, at a certain time. This time is dependent upon when the shift will be made from the current production of the first printed product to the subsequent production of the second printed product, in accordance with the available production data. Resetting is to be initiated and executed when the first production run, executed using the first web of material, is completed, once the number of copies of the first printed product which are to be produced, according to the production data relating to this first print product, have been produced. The control command issued to the control unit of the roll changer 08 by the press control unit 11; 12, which controls at least the current production of the first printed product, is not executed, for example, if the control unit of the roll changer 08 sends an error message to the press control unit 11; 12, which controls at least the current production of the first printed product. Such an error message may be sent by the control unit of the roll changer 08 because no web of material has been provided to the roll changer 08, for example, or because the incorrect web of material has been provided. When an error message has been sent, the press control unit 11; 12, which controls at least the current production of the first printed product, can trigger a shutdown of the printing press 01, if necessary.

The control unit 02 of the material supply system causes the rolls of the respective print substrate, which may be required for executing the respective print order, to be provided, as needed, to the roll changer 08, each at the proper time, based upon the production data received from the control unit 16 of the production planning system, or optionally via a manual input. In other words, the control unit 02 of the material supply system decides, on the basis of the production data preferably received from the control unit 16 of the production planning system, which rolls of which print substrate are to be ordered from the daily storage facility 24 or from the main storage facility and are to be transported to the roll changer 08, and in what order they are to be so transported. The control unit of the roll changer 08 reports back to the control unit 02 of the material supply system, among other things, whether the roll changer 08 is ready to execute a roll change, and/or the circumferential speed at which the new roll, which has been prepared for the splicing process, is traveling and/or whether a new roll will be required because the currently expiring roll will be consumed, for example, and/or the diameter of a residual roll that needs to be removed from the roll changer 08. The control unit 02 of the material supply system can preferably report back to the control unit 16 of the production planning system what roll or rolls and/or how many rolls of a certain print substrate have been consumed in executing a certain print order, for example.

In the control plan in accordance with the present invention, the control unit 02 of the material supply system controls all the processes that have anything to do with the loading of the roll changer 08 with the print substrate that is required to execute a certain print order. This control is based upon the production data which is received from the control unit 16 of the production planning system. The press control unit 11; 12, which controls at least the current production of the first printed product, controls all processes in the printing press 01 based upon the same set of available production data. The press control unit 11; 12 ensures that, in the case of a production shift in the printing press 01, and including the folding unit 07 allocated to it, adjustments which may be required to execute the new production order, are completed on time and in the proper sequence. Thus, different processes or control sequences are coordinated with one another by the control unit 02 of the material supply system and by the press control unit 11; 12 which controls at least the current production of the first printed product, based upon the same production data provided, for example, by the control unit 16 of the production planning system, and are synchronized, if necessary.

Figure 17:
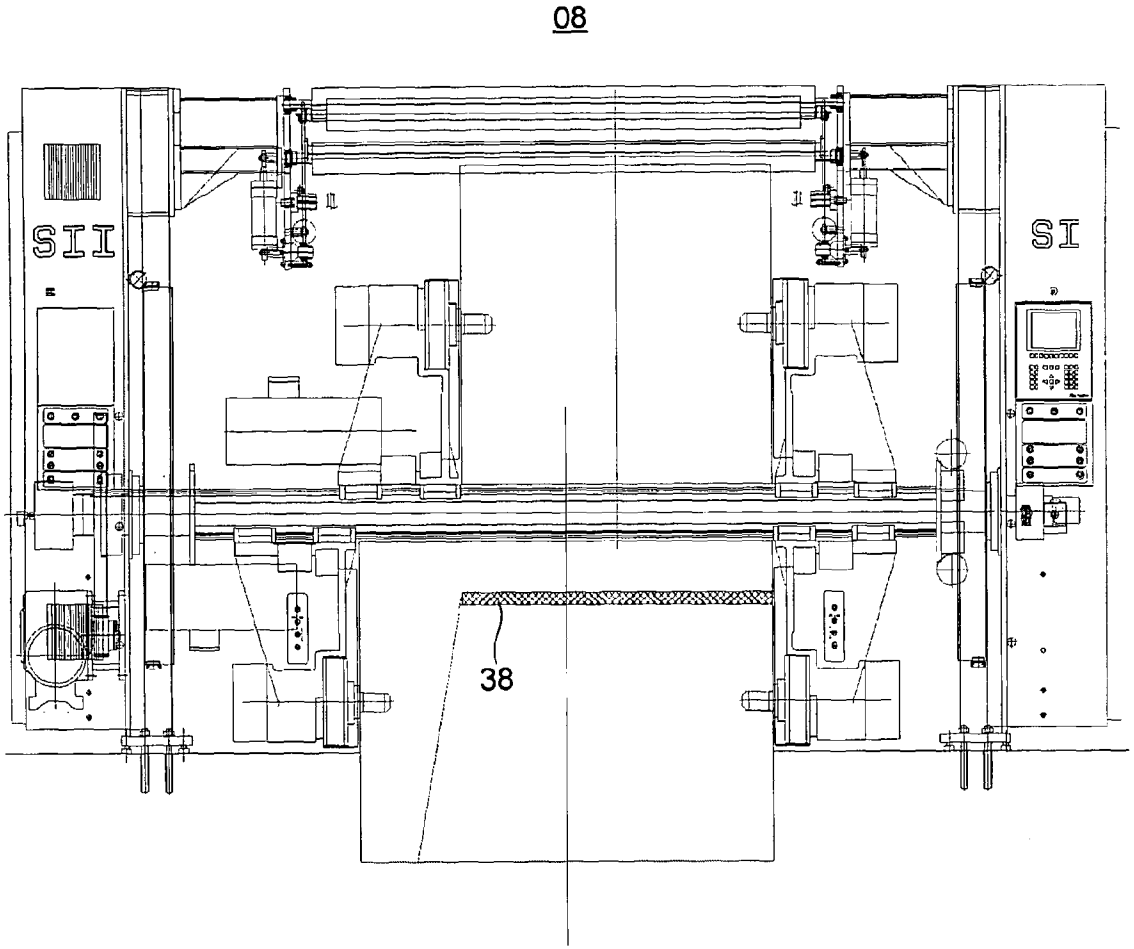
FIG. 17 a roll changer with a ¾-width roll and a ⁴⁄₄-width roll.
Figure 18:
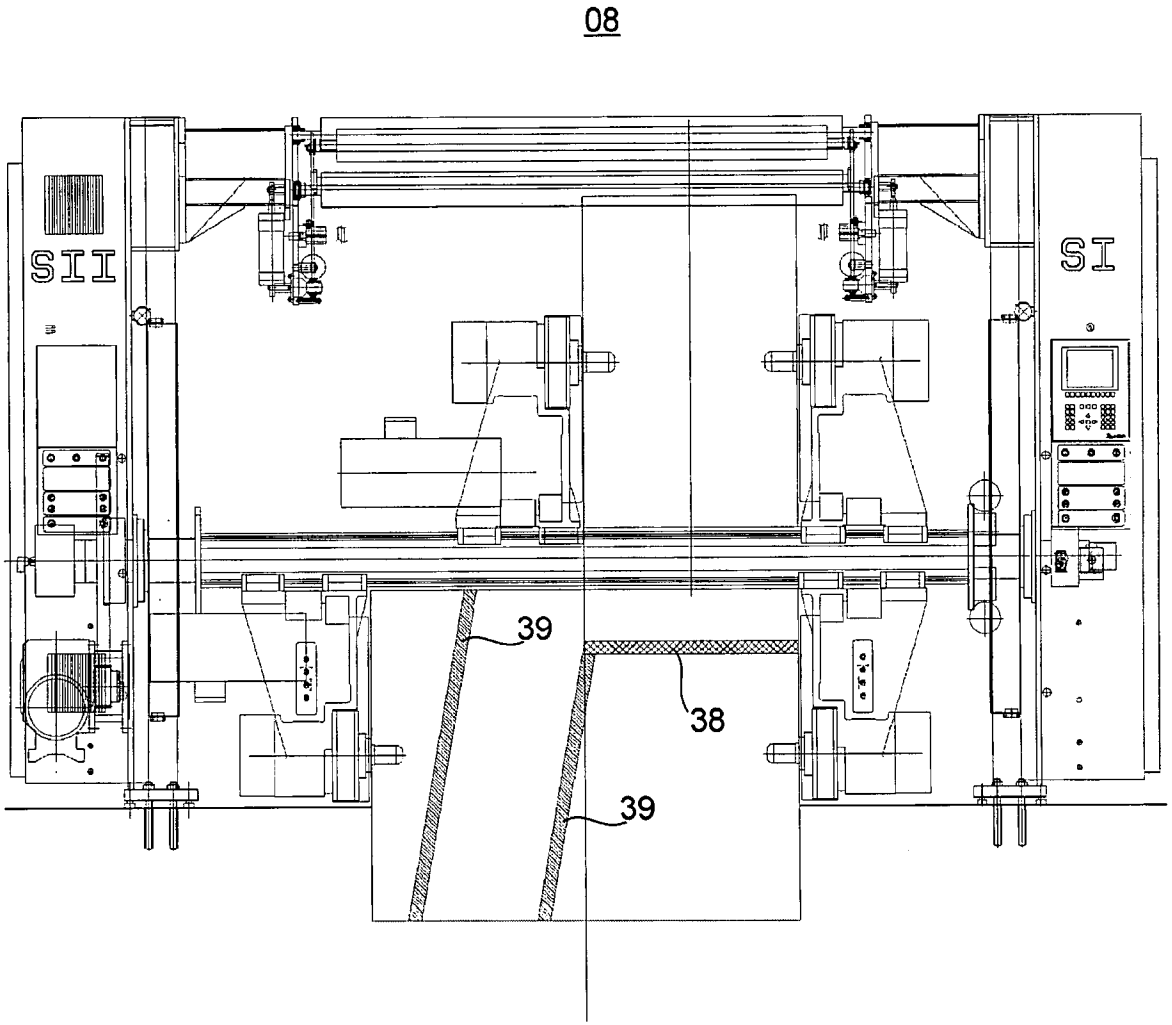
FIG. 18 a roll changer with a ²⁄₄-width roll and a ⁴⁄₄-width roll.
Figure 19:
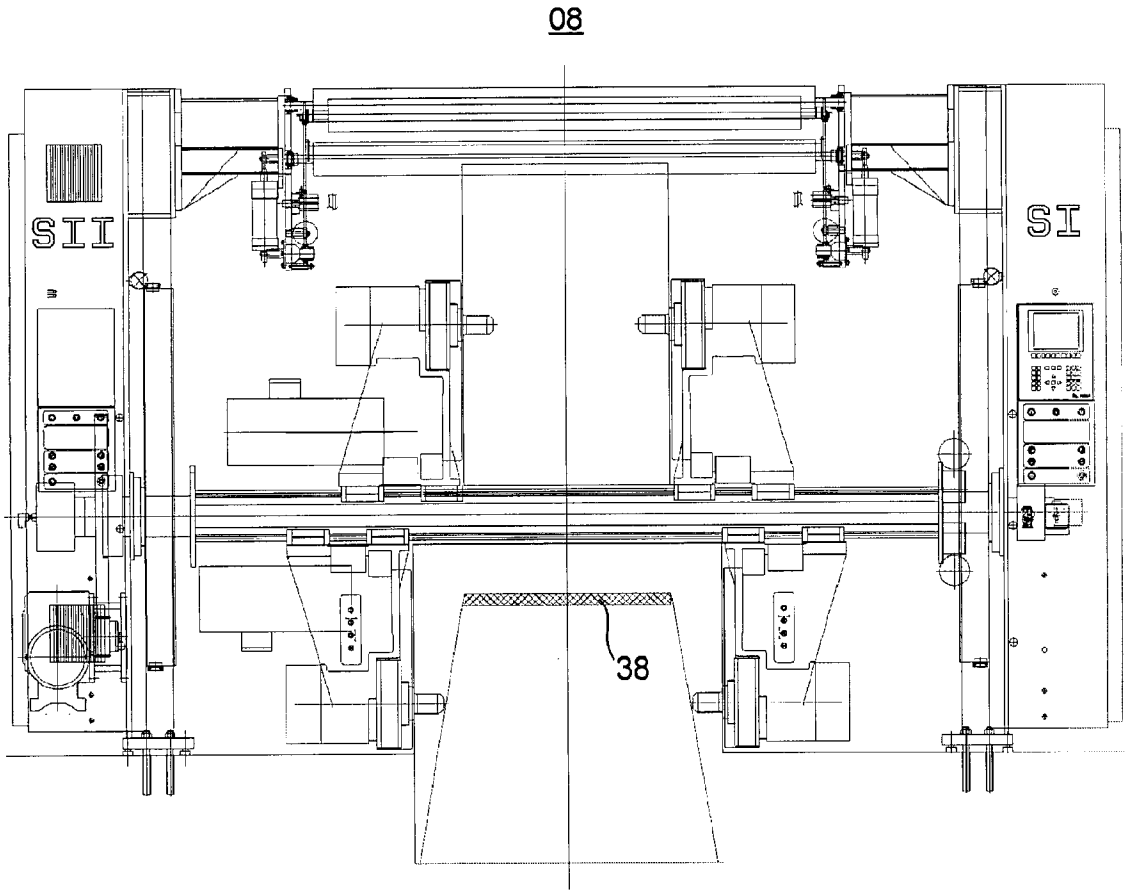
FIG. 19 a roll changer with a ²⁄₄-width roll and a ¾-width roll.

Between its parallel side frames, which are spaced from one another and which are identified, for example, as side SI and side SII, all as may be seen in FIGS. 17-19, the printing press 01 forms a transport plane, in which the respective webs of material to be imprinted can be transported. A width of the so-formed transport plane, extending transversely to the direction of transport of the respective webs of material, is relatively limited, for example, by the axial length of the printing couple cylinders, but is at least absolutely limited by the distance between the side frames. The width of the transport plane therefore determines a maximum width of the web of material that can be fed through the respective printing press 01. The maximum width of the respective web of material can thus correspond to the width of the transport plane, or can be narrower than the width of the structurally determined width of the transport plane in the printing press 01. In the case of a printing press 01 having a forme cylinder, and having a circumferential surface on which four printing formes are arranged, or at least on which four printing formes can be arranged, side by side in its axial direction, for example, the width of the transport plane is divided into eight preferably equidistant sub-sections, for example. In the case of a printing press 01 having a forme cylinder, on the circumferential surface of which six printing formes are arranged, or on which circumferential surface at least six such printing formes can be arranged, side by side in its axial direction, for example, the width of the transport plane can be divided into twelve preferably equidistant sub-sections, for example. If the width of the respective web of material occupies the full width of the transport plane, the web of material is referred to as a 1/1web. If the width of the respective web of material occupies only a portion of the width of the transport plane, the web of material is identified by the ratio of the width of the transport plane it occupies, in other words ½-width, ¾-width, ⅞-width, etc., for example. A web of material, the width of which occupies only a portion of the width of the transport plane can be positioned differently with respect to the width of the transport plane. It can be aligned either on, or against, the one or on, or against, the other opposite side frame, on the side SI or on the side SII. Alternatively, the web can be positioned centered between the two side frames, for example.

Figure 14A:
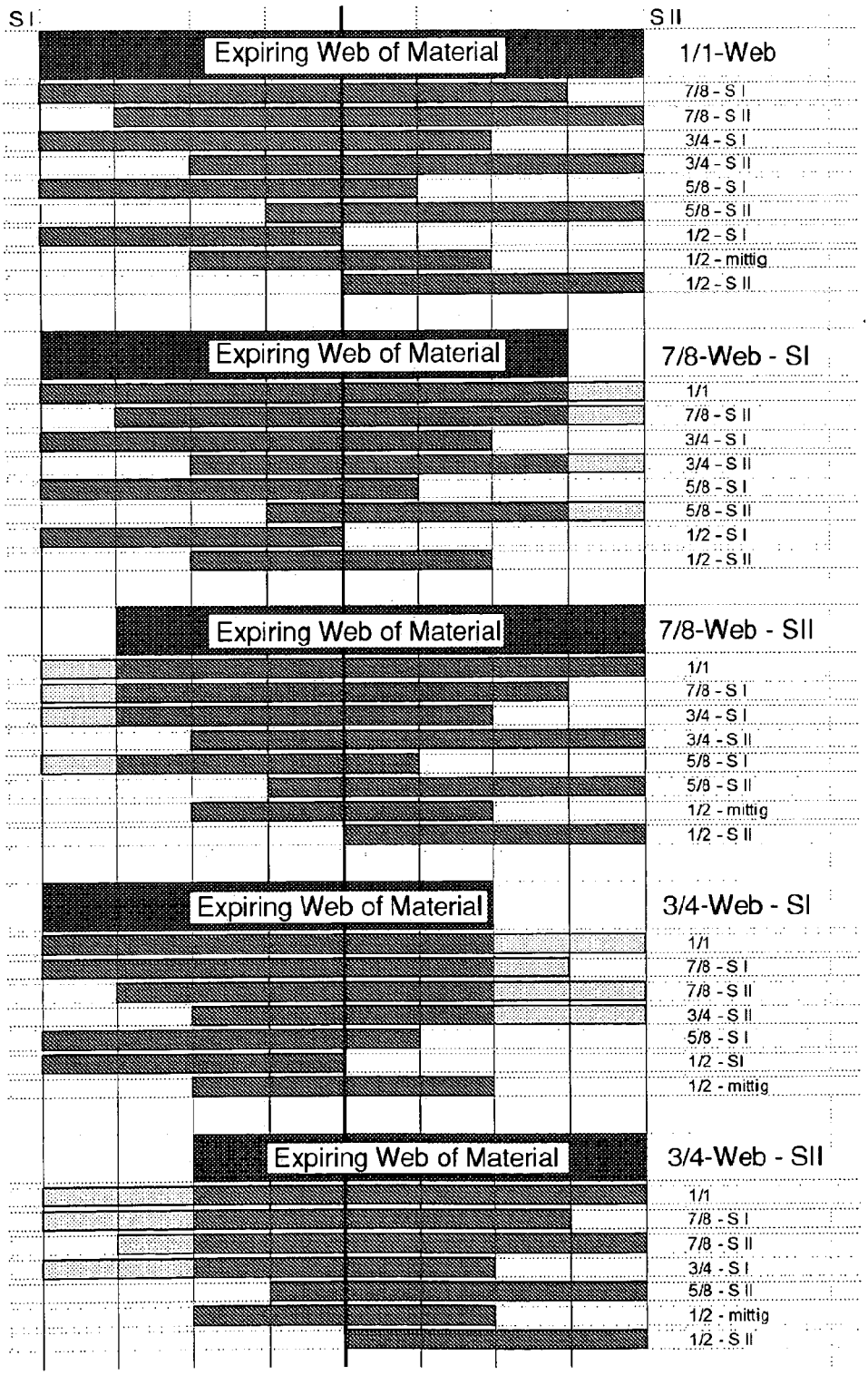
FIGS. 14*a* and 14*b* possible combinations of webs of material of different widths to be connected to one another.
Figure 14B:
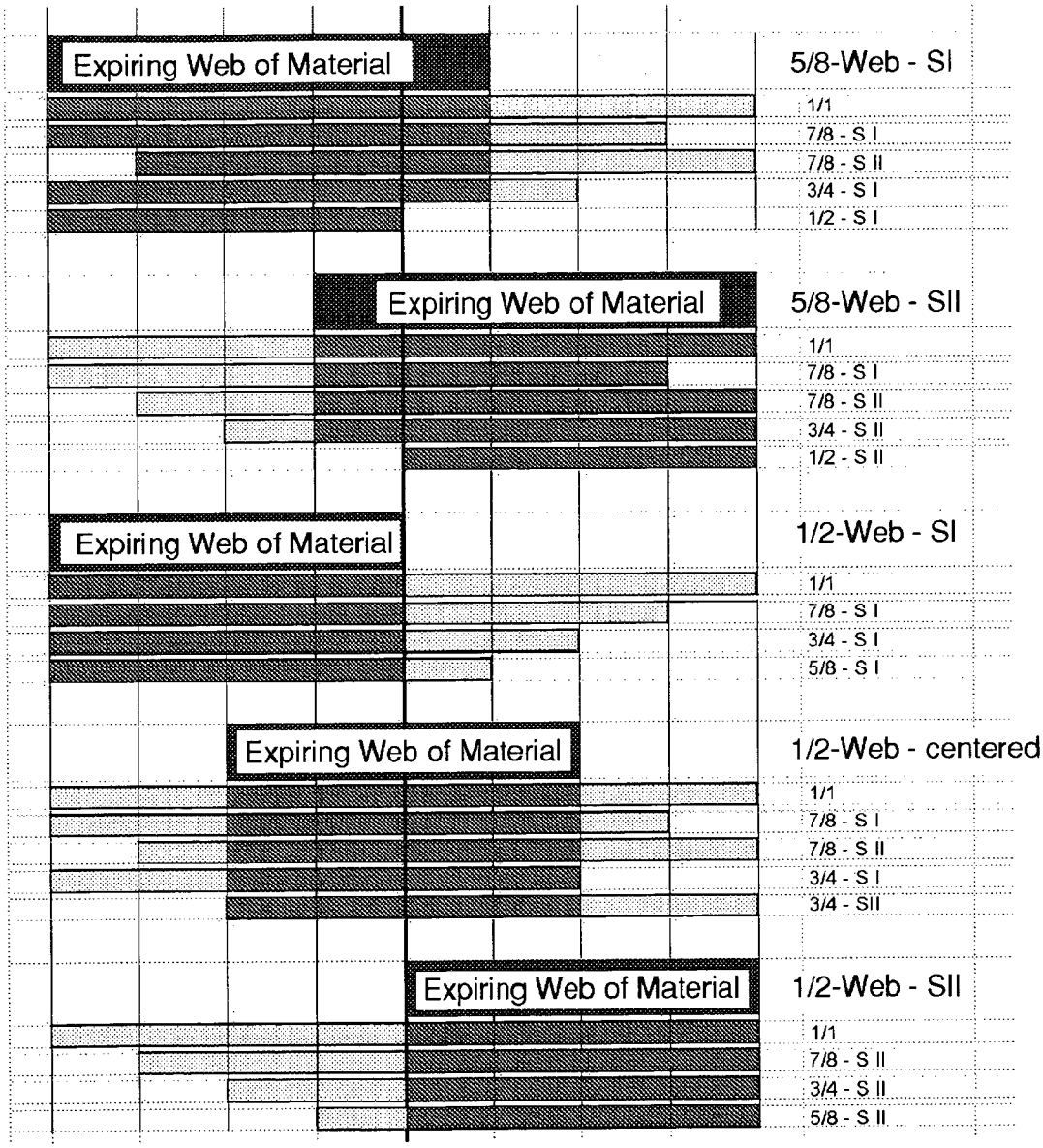

In the case of a change from a first production of a first printed product to a subsequent, second production of a second printed product, which change is performed automatically using a roll changer 08, for example, and in which a second web of material having a second width is connected to a first web of material having a first width, which is different from the second width, there should be an overlap of at least one-half the full web width, for example, between the first width of the first web of material and the second width of the 4 second web of material. This is needed in order to produce a reliable connection between the first web of material and the second web of material. In most cases, the minimum overlap of webs of material of different widths that are to be joined to one another is at least several hundred millimeters, and typically ranges between 500 mm and 1,200 mm, for example. Taking this condition into account, and considering the various possibilities for arranging these webs of material in the area determined by the width of the transport plane, and further in the example in which the width of the transport plane is divided into eight preferably equidistant sub-sections, the possible combinations of webs of material that can be joined to one another are shown in FIGS. 14*a* and 14*b*. FIG. 14*b* represents a continuation of FIG. 14*a*. In each embodiment, the expiring first web of material, with its first width, is indicated by the black bar. Below this black bar, representations of allowable second webs of material, with their respective second widths follow. The respective requisite areas of overlap, between the width of the first web of material and the width of the second web of material, which is to be newly fed to the printing press 01, is shown darker than the remainder of the respective width of the second web of material, if the second web of material is wider than the first web of material, or if the second web of material is supplied to the first web of material of the printing press 01 with a lateral offset. The second web of material is preferably prepared for splicing in a presumable area of overlap between its width and the width of the first web of material, in order to produce the connection between the two webs of material.

Figure 15:
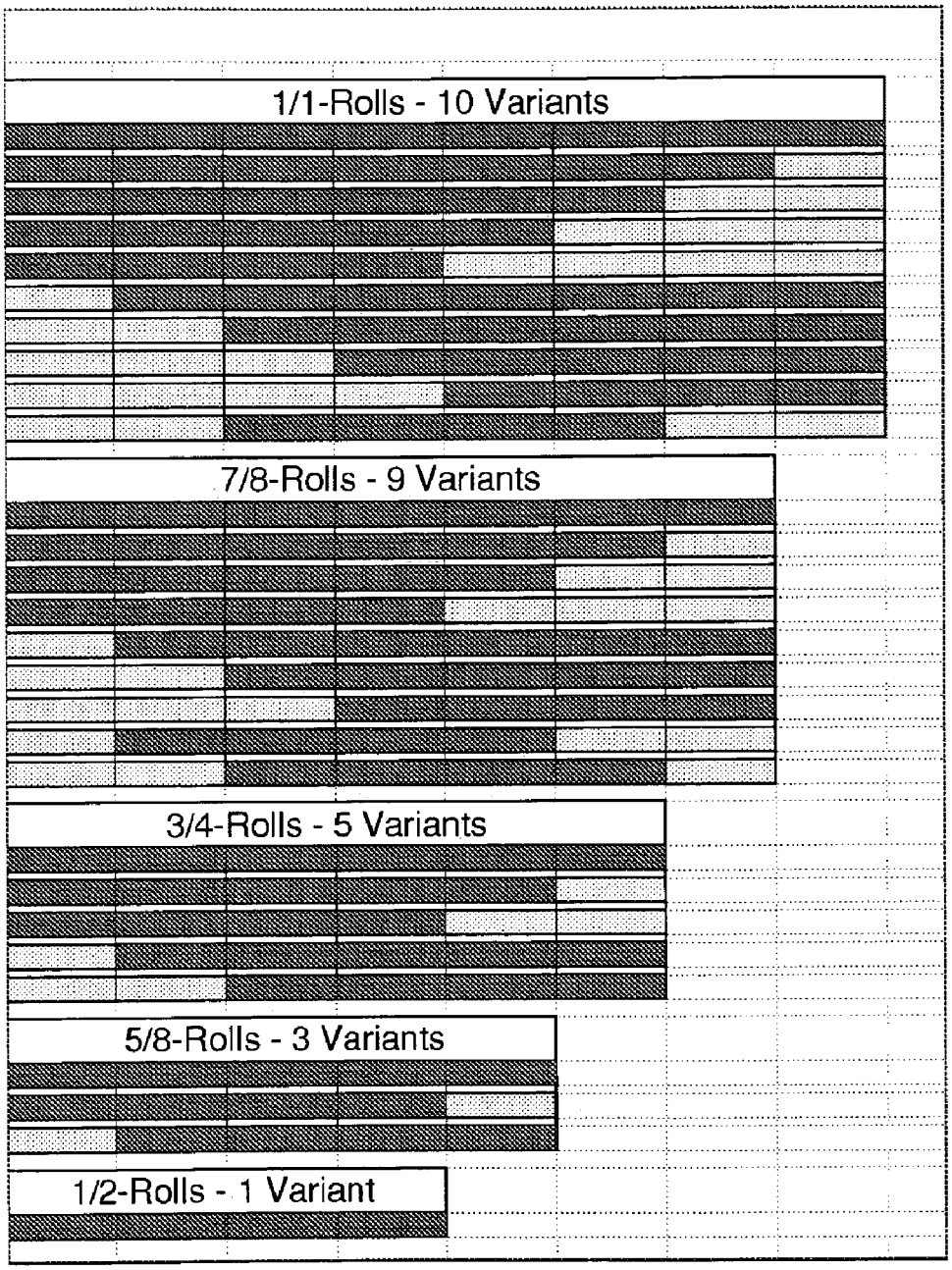
FIG. 15 a representation of the number of variants of webs of material of different widths, with a minimum overlap.

FIG. 15 shows, within the context of the general example of a printing press 01 with a forme cylinder, and on the circumferential surface of which forme cylinder four printing formes are arranged, or at least on which four printing formes can be arranged, side by side in its axial direction, the number of possible variations for webs of material of different widths, under the condition that the overlap area of the first width of the first web of material with the second width of the second web of material is at least one-half the width of the transport plane. The number of variations is shown in each case for a 1/1-width roll, for a 7/8-width roll, for a 3/4-width roll, for a 5/8-width roll and for a 1/2-width roll. In this example, a total of 28 variations result, all of which variations are to be controlled by the control unit 02 of the material supply system, and can especially be displayed on the display unit of the control unit of the roll preparing station 27. Once the splice preparation has been completed for a specific roll, the respective variation can be confirmed at the operating unit of the control unit of the roll preparing station 27, for example, via a corresponding input or selection, unless an automatic detection is provided for this purpose. For a printing press 01 with a forme cylinder, on the circumferential surface of which forme cylinder six printing formes are arranged, or at least on which surface six printing formes can be arranged, side by side in its axial direction, for example, the number of variants is significantly greater. The width of the transport plane is then divided into twelve, preferably equidistant, sub-sections, for example, resulting in a graduation of the variations in stages of 1/12-width. This greater number of variations is also controlled, as has been mentioned above, by the control unit 02 of the material supply system, and preferably is visualized at the roll preparing station 27.

If the second web of material is narrower than the first web of material, it is generally sufficient to form a splice preparation on the leading edge of the second web of material, and extending substantially along the width of the transport plane, in order to produce a reliable connection between these two webs of material of different widths. However, if the second web of material is wider than the first web of material, it is proposed that the splice preparation be enlarged by forming a beveled or angled section at the leading edge of the second web of material. The beveled section is preferably embodied as a gluing tab. Such a beveled or angled section is preferably formed by beveling or angling the leading edge of the second web of material in its direction of transport. If the second web of material is wider than the first web of material by a maximum of 1/4 the full web width, a beveling or angling of the second web of material, in its direction of transport, over a length L of approximately 2 m may be sufficient, without the beveling or angling being more intense along its edge area. A length L of the beveled or angled area, of approximately 2 m, corresponds to approximately one-half the circumference of a new roll. If, however, the second web of material is wider than the first web of material by more than one-fourth the full web width, or in other words, by more than one-fourth the maximum allowable width for these webs of material, such as, for example, if a change will be made from a 1/2-width first web of material to a 7/8-with or to a 1/1-width second web of material, then a beveled or angled section, with a beveled or angled area measuring several meters in length must be formed on the second web of material. The length L of the beveled or angled area can measure 6 m to 8 m in the direction of transport of the second web of material, for example. The beveled or angled area is also preferably reinforced, along its edge, by an adhesive tape. A length L of the beveled or angled area of approximately 6 m to 8 m corresponds to, from approximately one-and-a-half times to up to double, the circumference of a new roll.

Figure 16:
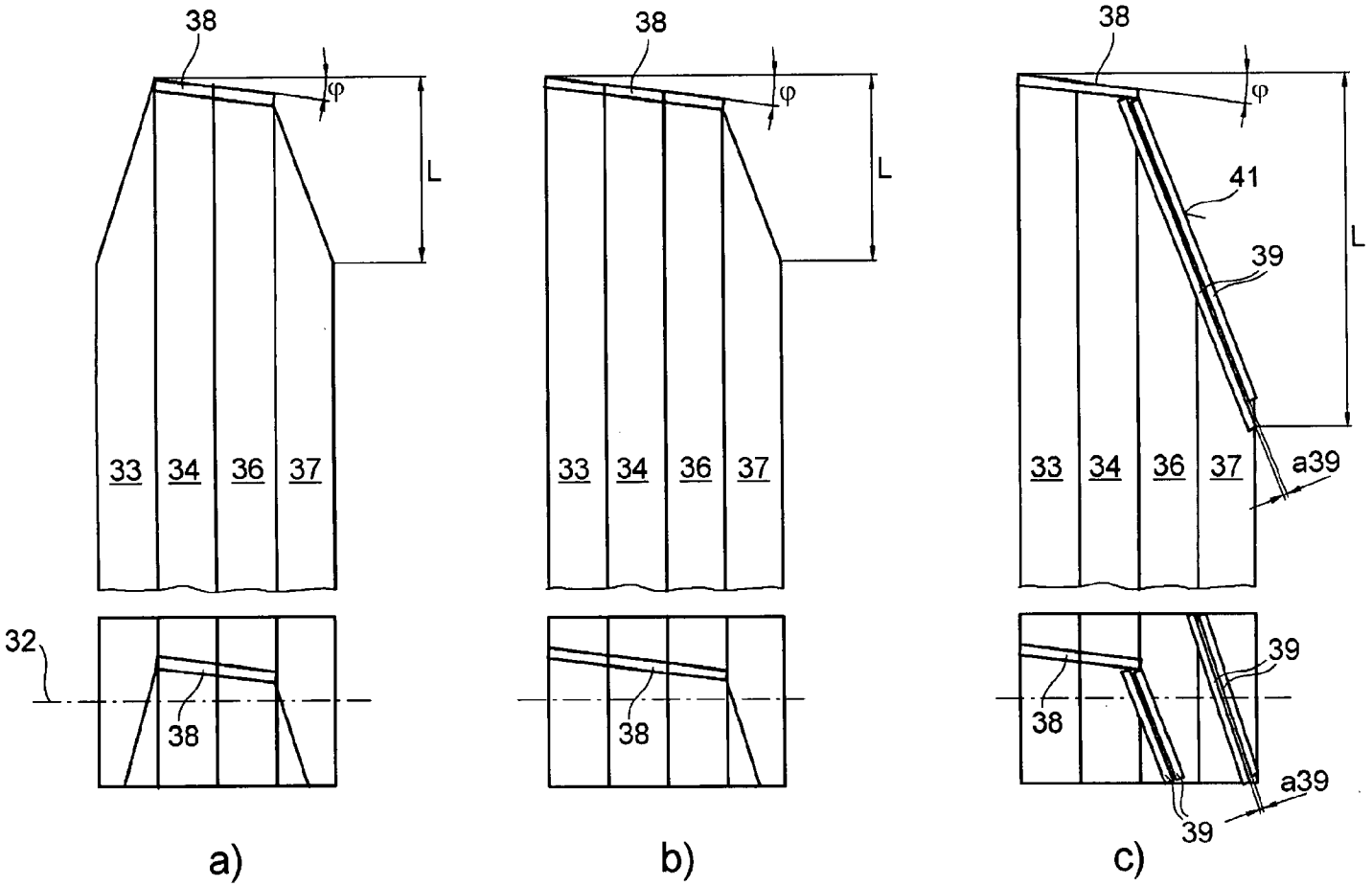
FIG. 16 three examples of a splice preparation of a second web of material.

FIG. 16 illustrates a splice preparation of a second web of material within the context of three examples a), b) and c). In each of these three examples, and as depicted in the lower area of the diagram, the second web of material, which has been prepared for splicing and which is wound around a central axis 32 onto a roll, is shown in a plan view. The upper area of each diagram shows the leading edge of the second web of material, which has been unwound from the respective roll. In each of the three examples, the respective second web of material is divided transversely to its direction of transport into four equidistant sub-sections 33; 34; 36; 37. In each of the three examples there is an overlap between the width of the first web of material and the width of the second web of material, of at least one-half the full web width, or, in these examples, an overlap of at least two adjacent sub-sections 33; 34; 36; 37. This overlap is provided in order to produce a reliable connection between the first web of material and the second web of material.

In example a), with a change in production, a second web of material that extends over the full width, i.e., a 4/4-width web, is to be joined to a 2/4-width first web of material. The 2/4-width first web of material extends centered in relation to the 4/4-width second web of material. On both sides of the 2/4-width first web of material, in the transition to the 4/4-width second web of material, a jump in width of 1/4 the full web width results. The full web width is the maximum allowable web width for these webs of material. To prepare to form a connection between the 4/4-width second web of material and the 2/4-width first web of material, a gluing tab is formed. The 4/4-width second web of material is beveled or is angled on both sides of its leading edge, in its outer sub-sections 33; 37, over a length L of approximately 2 m. With a jump in width of at most only 1/4 the full web width, it generally is not necessary to reinforce the respective edge area of the beveled or angled areas that are formed on the second web of material. On the gluing tab, in an end area of the second web of material, a double-sided adhesive tape 38 is applied to the two center sub-sections 34, 36, and extending substantially transversely to the direction of transport of this second web of material, at an inclination angle $\phi$ of less than 10°, and preferably at an inclination angle $\phi$ from 1° to 2°, with which double-sided adhesive tape the connection to the 2/4-width first web of material will be made at a later time. The angling in the application of the double-sided adhesive tape 38 provides an advantage when the splice passes between the first web of material and the second web of material, such as, for example, in the roller gap between printing couple cylinders engaged against one another. This angling prevents linear stress extending in the axial direction of these printing couple cylinders.

In example b), with a change in production a second web of material, which is a 4/4-width web, which extends over the full width, is to be joined to a 3/4-width first web of material. A jump in width of 1/4 of the full web width results on one side of the 3/4-width first web of material in the transition to the 4/4-width second web of material. In this second example b) as well, a gluing tab is formed on the 4/4-width second web of material. The 4/4-width second web of material is beveled or angled along one side of its leading edge, namely in the outer sub-section 37 in this case, over a length L of approximately 2 m as in example a). No reinforcement along the edge of the beveled or angled area, which is formed on the second web of material, is necessary because of the jump in width of only 1/4 the full web width. Once again, a double-sided adhesive tape 38 is applied to the gluing tab, specifically in the sub-sections 33; 34; 36, preferably at a slight inclination, and extending generally transversely to the direction of transport of the second web of material.

In example c), with the change in production, a second web of material, such as, for example, a 4/4-width web, which extends over the full width, is to be joined to a 2/4-width first web of material. The two webs of material are both aligned with one of their end surfaces on the same side of the printing press 01. A jump in width of 2/4 the width of the full web width results on the side of the printing press which is opposite to the aligned side, in the transition from the 2/4-width first web of material to the 4/4-width second web of material. This jump in width is large enough that supplementary measures are required in addition to the above-described splice preparation. Such supplementary measures are utilized in order to prevent the 4/4-width second web of material from tearing as it is fed into the printing press 01, with such tearing being possible due to the substantial change in web tension conditions, as compared with the 2/4-width first web of material. The additional measures are provided with the aim to equalize the different web tension conditions in the two webs of material. To this end, the leading edge of the second web of material is beveled or is angled in the two adjacent sub-sections 36; 37 over a comparatively greater length L of 6 m to 8 m, for example. The edge area of this beveled or angled area then reinforced with a preferably flat reinforcement tape 39. Such a reinforcement tape 39 is configured, for example, as an adhesive tape 39 with adhesive on only one side. Depending upon the tensile strength of the selected reinforcement tape 39, which is used to reinforce the edge of the beveled or angled area, and/or depending on the resistance to cracking or on the tensile strength of the material of the second web of material, it may be appropriate to apply this reinforcement tape 39 preferably along the edge of this beveled or angled area parallel to an edge 41 of this beveled or angled area, for example, in a plurality of strips, such as, for example, two such strips which may be arranged parallel to one another. The two strips that are formed by the reinforcement tape 39 are preferably applied to the beveled or angled area at a distance a39 of a few millimeters, such as, for example, approximately 15 mm in from the edge 41. Each of these strips is between 30 mm and 50 mm wide, for example. A multilayer configuration of these strips should be avoided, because this would cause an undesirable thickening of the respective web of material. In the case of a large jump in width of significantly more than 1/4the full web width, and/or in the case of a web of material which is made of a material of low resistance to cracking, one or more additional strips of the reinforcement tape 39 can also be applied to the center area of the gluing tab, in addition to the edge of the beveled or angled area, in order to equalize the web tension occurring at the gluing tab over the width of the web of material as it is being fed in. On the gluing tab, in the sub-sections 33; 34 which are not included in the beveled or angled area, a double-sided adhesive tape 38 is again applied generally transversely to the direction of transport of the second web of material, and preferably at a slight angle.

In practical use, the length L of the beveled or angled section should be between at least 0.5 m and generally a maximum of 8 m, which length corresponds to between approximately one-half to twice the circumference of a roll, in the case of webs of material which are wound onto rolls. In this case, the edge 41 of the beveled area extends at an angle of less than 30°, for example, and preferably of less than 100, and particularly between 3° and 8°, from the planned direction of transport of this web of material. If the base weight of the second web of material ranges from 45 g/m$^2$ to 50 g/m$^2$, it is advantageous for the length L of the beveled or angled section to measure approximately ten times the planned jump in width. The greater the base weight and/or the greater the resistance to cracking of the second web of material, the shorter the length L of the beveled section can be. Base weight values for customarily used paper grades range from 25 g/m$^2$ to 150 g/m$^2$, and preferably range from 45 g/m$^2$ to 60 g/m$^2$. The reinforcement tape 39 should be applied along the edge of the beveled or angled area if the tensile strength of the second web of material is lower than 2,000 N/m. In this case, the tensile strength of paper transversely to the direction of its fibers is significantly lower than it is in the direction of its fibers. The planned direction of transport of the relevant web of material is generally always parallel to the direction of the fibers of that web of material. The reinforcement tape 39 should therefore be applied along the edge of the beveled area at least when the tensile strength of the web of material, which is typically embodied as a web of paper, is less than 1,000 N/m in the direction of its fibers, and is less than 600 N/m transversely to this direction.

The application of the reinforcement tape 39, along the edge of the at least one beveled or angled section of the second web of material, is particularly beneficial, and is typically provided when, in the formation of a connection between two webs of material of different widths, the second web of material is wider than the first web of material by more than one-fourth the maximum allowable web width for these webs of material, and/or when the length L of the beveled or angled section measures between eight and twenty times the difference in width between the first and second webs of material, and/or when the resistance to cracking of the second web of material is lower than that of the first web of material. These recited conditions for applying a reinforcement tape 39 along the edge of the at least one beveled or angled section of the second web of material are of interest especially when automatic methods for resetting a web-fed printing press, from a current production of a first printed product to a subsequent production of a second printed product, are performed. This is because these conditions can be monitored automatically by using available production data, for example, and/or by using current data measured on at least one of the webs of material. When one or more of these conditions exist, the application of the reinforcement tape 39 is automatically initiated by the control unit 02 of the material supply system, for example, and can be implemented in the roll preparing station 27, as depicted in FIG. 1, for example.

FIG. 17 shows a side view of a roll changer 08 with two pairs of support arms. One pair of these support arms holds a ¾-width first web of material which is wound onto a roll. The other, or second, pair of support arms holds a ⁴⁄₄-width second web of material which is also wound onto a roll. Each of the two rolls of material is aligned with one of its end surfaces flush with that of the other roll, on the same side of the roll changer 08. To prepare a splice to be produced between the first and the second webs of material, the leading edge of the second web of material is equipped with a gluing tab which is beveled or angled along one side. A double-sided adhesive tape 38 is also applied, transversely to the direction of transport of the second web of material, and preferably at a slight angle, in the three sub-sections that are not beveled or angled. The configuration of web rolls, which are shown in FIG. 17, correspond to those of example b) of FIG. 16. The connection or splice of the second web of material to the first web of material, which first web of material is being unwound from its roll during the current production run, is formed only after the roll with the second web of material has been accelerated from its stationary status, for example, to the point at which its circumferential speed is equal to the transport speed of the first web of material.

FIG. 18 also shows a side view of a roll changer 08 with two pairs of support arms. One pair of the support arms holds a ¾-width first web of material which is wound onto a roll. The other pair of support arms holds a ⁴⁄₄-width second web of material which is also wound onto a roll. Each of the two rolls is aligned, with one of its end surfaces flush with that of the other roll, on the same side of the roll changer 08. To prepare for production of a splice between the first and the second webs of material, the leading edge of the second web of material is equipped with a gluing tab which is beveled or angled along one side. A double-sided adhesive tape 38 is also applied to the gluing tab, transversely to the direction of transport of the second web of material, and preferably at a slight angle, in the two sub-sections of the second web that form the gluing tab and that are not beveled or angled. Additionally, due to the large increase in width from the first web to the second web, of ¾ the full web width, a reinforcement tape 39, preferably in the form of two preferably parallel strips, for example, is applied along the edge of the beveled or angled area or the second web and preferably extending over a length L of 6 m to 8 m, for example. The configuration which is shown in FIG. 18 corresponds to those of example c) of FIG. 16. The connection of the second web of material to the first web of material, which first web of material is being unwound from its roll during the current production run, is again formed only after the roll, with the second web of material, has been accelerated from its stationary status, for example, to the point at which its circumferential speed is equal to the transport speed of the first web of material.

FIG. 19 also shows a side view of a roll changer 08 with two pairs of support arms. One pair of support arms holds a ¾-width first web of material which is wound onto a first roll. The other pair of support arms holds a ¾-width second web of material which is wound onto a second roll. The two rolls are both aligned centered in the roll changer 08. A gluing tab, which is possibly slightly beveled or angled on both sides, and over a length L of approximately 2 m, is formed on the leading edge of the second web of material. A double-sided adhesive tape 38 is again applied to the two beveled areas, which are preferably provided with a slight inclination, and which are extending generally transversely to the direction of transport of the second web of material. No reinforcement is necessary along the edge of the beveled or angled areas which are formed on the second web of material, spaced on both sided of the gluing tab, due to the small jump in width of only ¼ the full web width. As in the configurations shown in FIGS. 17 and 18, the connection of the second web of material to the first web of material, which first web of material is being unwound from its first roll during the current production run, occurs here again only after the roll with the second web of material has been accelerated from its stationary status, for example, to the point at which its circumferential speed is equal to the transport speed of the first web of material.

Figure 20:
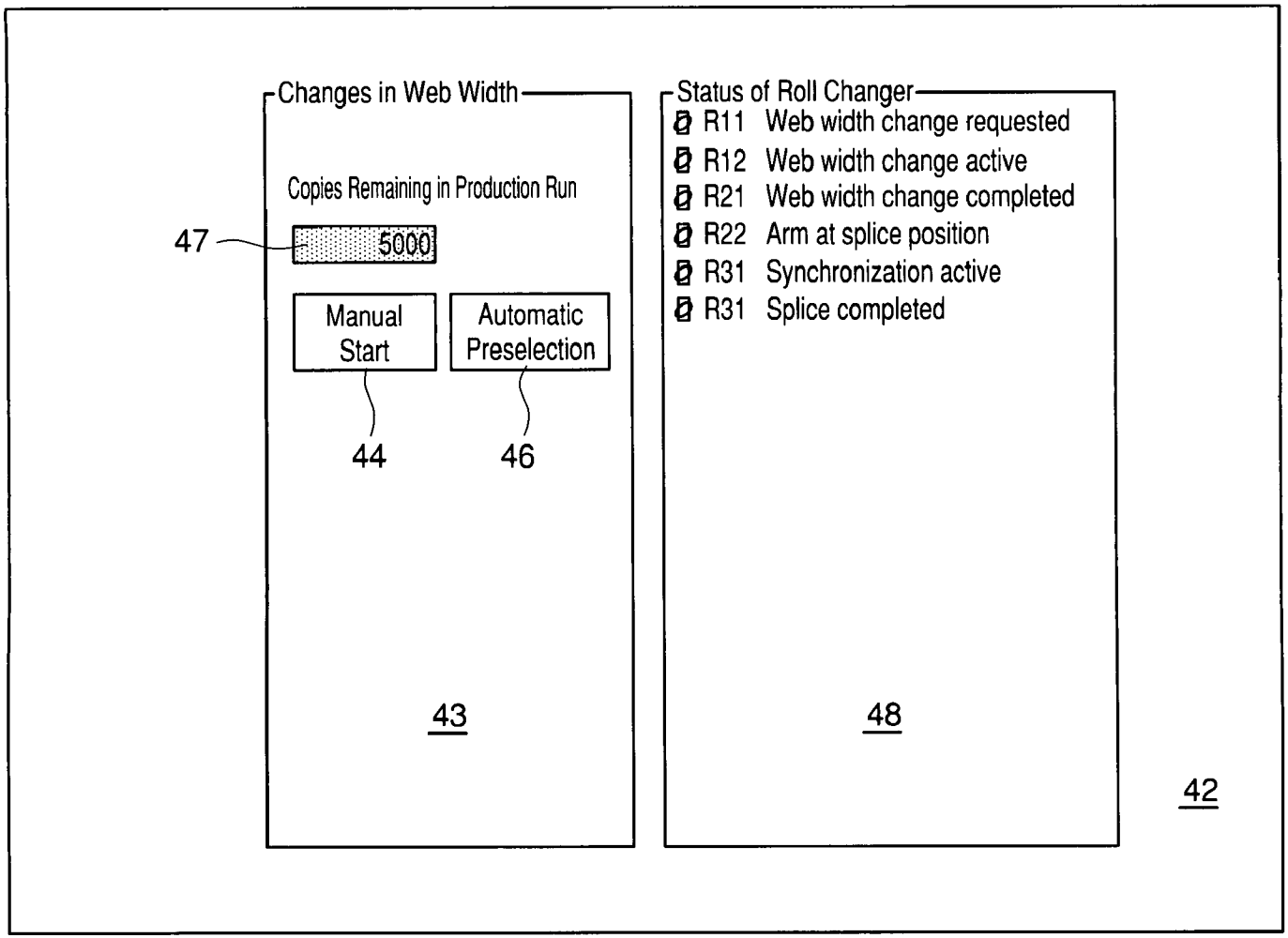
FIG. 20 a program mask for performing an automatic change in web width with respect to the print product to be produced.

FIG. 20 shows a program mask 42, which can be displayed on the display device of one of the press control stations 11; 12, for example. This program mask 42 is part of a program which controls the sequence of the process for resetting the web-fed printing press from a current production of a first printed product to a subsequent production of a second printed product. The widths and/or grades and/or base weights of the material of the respective webs of material, for example, may differ from one another. In other words, a so-called web width change is automatically performed. The program mask 42 has an operating field 43, for example, in which operating field 43 it can be determined, by actuating the corresponding control field 44 or 46, for example, whether the process for resetting the web-fed printing press, from a current production of a first printed product, to a subsequent production of a second printed product will be manually controlled by an operator, or will be run automatically solely via program control. In FIG. 20, by way of example, the interfaces 46, that are assigned to the automatic implementation of this process, are shown as being activated. In the case of the automatic implementation of this process, as is shown by way of example in FIG. 20, in one input field 47 a remaining number of copies of the first printed product, for example 5,000 copies, as shown, is entered. When the production of only this remaining number of copies of the first printed product remains in the current production run, the program, preferably implemented in one of the press control stations 11; 12, initiates the implementation of this process for resetting the web-fed printing press from a current production of a first printed product to a subsequent production of a second printed product. The sequence of this process is shown in FIG. 12, and has been described in the section of the specification which is associated with FIG. 12. The time at which the number of copies remaining of the first printed product, which number of copies can be variably input, and which actually are input, into the input field 47, is reached correlates, in FIG. 12, with the time t1 shown there. At this time, the press control unit 11; 12 of the printing press 01 begins to reduce the preferably maximum production speed n1 of the printing press 01, to begin, for example, the transition from section A to section B, as depicted in the process sequence shown in FIG. 12.

The program mask 42 also has at least one display field 48, for example, in which preferably at least one operating status of different units of the web-fed printing press, which are involved in implementing this process of resetting the web-fed printing press from a current production of a first printed product to a subsequent production of a second printed product, is displayed. In the example shown in FIG. 20, the displayed operating states refer to successive operating states of at least one roll changer 08 that is involved in the process. The displays are updated in the display field 48 based upon events, for example.

While preferred embodiments of a method for supplying a web of material of predetermined lengths to a printing press, for producing a printing product, in accordance with the present invention, have been set forth fully and completely hereinabove, it will be apparent to one of skill in the art that various changes in, for example, the specific structure of the printing presses, the types of roll changers used, the specific nature of the gluing tapes, and the like could be made without departing from the true spirit and scope of the present invention, which is accordingly to be limited only by the appended claims.

What is claimed is:

1. A method of supplying a web of material of predetermined length to a printing press for producing a printed product during a current production run, including:

determining a length of a print run of the printed material to be printed continuously;

determining a length of the web of material based on said print run;

forming the web of material length using a plurality of partial webs joined in a line in succession, at least some of said plurality of partial webs having partial web lengths different from each other;

providing a storage facility and using such storage facility for storing said plurality of partial webs of different partial web lengths;

providing a material management system having a material management system control unit for controlling said storage facility;

providing a production planning system having production data;

using said material management system control unit for determining a demand for selected ones of said plurality of partial webs, with respect to the length of the web of material, based on said production data;

feeding said selected ones of said plurality of said partial webs of material to said printing press in a defined sequence using said material management system;

providing a last one in said defined sequence of said selected ones of said plurality of partial webs with a minimum length;

determining a web of material transport speed;

determining a cycle period of said printing press as a period of time during which one of a web of material and a partial web of material is being prepared for introduction into said printing press; and determining said minimum length of said last one of said plurality of partial webs based on said web of material transport speed wherein an end of said production run is reached using said last one of said plurality of partial webs at the earliest when said cycle period has elapsed.

2. The method of claim 1 further including providing each of said partial webs as a roll.

3. The method of claim 2 further including a roll changer for said printing press and unwinding each said partial web using said roll changer.

4. The method of claim 3 further including providing said roll changer adapted to hold two of said rolls.

5. The method of claim 2 further including providing a partial roll as a last one of said rolls.

6. The method of claim 5 further including using a partial roll from a previous production run before said last one of said rolls.

7. The method of claim 2 further including providing a full roll as a first one of said rolls.

8. The method of claim 2 further including providing a partial roll as a first one of said rolls.

9. The method of claim 2 further including providing a full roll as a last one of said rolls.

10. The method of claim 2 further including using a partially consumed roll from a previous production run intermediate first and last rolls used in said current production run.

11. The method of claim 1 further including joining said plurality of partial webs in a current production run.

12. The method of claim 11 further including providing only two of said partial webs for forming said length of the web of material.

13. The method of claim 1 further including using said cycle period for preparing at least one partial web of material for use in a subsequent production run of said printing press.

14. The method of claim 1 further including joining said plurality of partial webs by splicing.

15. The method of claim 1 further including determining said length of the web of material using a given configuration of the printing press, said given configuration taking into consideration sizes of circumference of cylinders of the printing press usable in printing said printed product, ways print images are loading on said cylinder, different production types of said printing press and a number of pages of said printed product.

16. The method of claim 1 further including using said material management system control unit for determining said demand for each selected ones of said plurality of partial webs based on said production data and including at least one of waste copies and reserve copies.

17. The method of claim 1 further including using said material management system control unit for controlling the provision of said partial webs to execute a specific print order and for allocating said partial webs to said printing press at a specific time.

18. The method of claim 1 further including fully consuming each of said partial webs prior to a last one of said partial webs in said current production run.

* * * * *